US012622563B2

(12) United States Patent
Duan et al.

(10) Patent No.: US 12,622,563 B2
(45) Date of Patent: May 12, 2026

(54) AUTOMATIC CLEANING DEVICE

(71) Applicant: Beijing Roborock Technology Co., Ltd., Beijing (CN)

(72) Inventors: Chuanlin Duan, Beijing (CN); Pan Cheng, Beijing (CN); Rongxin Hu, Beijing (CN); Erdong Gu, Beijing (CN); Dahong Gong, Beijing (CN); Zhimin Yang, Beijing (CN); Guang Yu, Beijing (CN)

(73) Assignee: Beijing Roborock Technology Co., Ltd., Beijing (CN)

( * ) Notice: Subject to any disclaimer, the term of this patent is extended or adjusted under 35 U.S.C. 154(b) by 343 days.

(21) Appl. No.: 18/276,842

(22) PCT Filed: Feb. 9, 2022

(86) PCT No.: PCT/CN2022/075594
§ 371 (c)(1),
(2) Date: Aug. 10, 2023

(87) PCT Pub. No.: WO2022/171105
PCT Pub. Date: Aug. 18, 2022

(65) Prior Publication Data

US 2024/0315518 A1 Sep. 26, 2024

(30) Foreign Application Priority Data

Feb. 10, 2021 (CN) ..... 202110186818.7
Feb. 10, 2021 (CN) ..... 202120375551.1

(51) Int. Cl.
*A47L 11/40* (2006.01)
*A47L 11/24* (2006.01)
*A47L 11/284* (2006.01)

(52) U.S. Cl.
CPC ..... *A47L 11/4069* (2013.01); *A47L 11/24* (2013.01); *A47L 11/284* (2013.01); *A47L 11/4036* (2013.01)

(58) Field of Classification Search
CPC ..... A47L 11/00; A47L 11/40; A47L 11/4063; A47L 11/4069; A47L 11/4036;
(Continued)

(56) References Cited

U.S. PATENT DOCUMENTS 5,857,718 A 1/1999 Kleinschmidt
10,292,553 B1 5/2019 Ebrahimi et al.
(Continued)

FOREIGN PATENT DOCUMENTS

CN 204500545 U * 7/2015
CN 108498015 A 9/2018
(Continued)

OTHER PUBLICATIONS

International Search Report (ISR1) and dated Apr. 24, 2022, issued in related International Patent Application No. PCT/CN2022/075594 International Search Report.
(Continued)

*Primary Examiner* — C. A. Rivera
(74) *Attorney, Agent, or Firm* — Morgan, Lewis & Bockius LLP

(57) ABSTRACT

Provided is an automatic cleaning device, including: a mobile platform configured to move automatically on an operating surface; and a cleaning module arranged on the mobile platform. The cleaning module includes a dry-cleaning module configured to clean at least a part of the operating surface by means of dry cleaning; and a wet-cleaning module configured to clean at least a part of the operating surface by means of wet cleaning. The wet-cleaning module includes a cleaning head configured to
(Continued)

clean the operating surface; and a driving unit configured to drive the cleaning head to substantially reciprocate along a target surface, the target surface being a part of the operating surface. The driving unit includes a driving platform and a supporting platform detachably connected to the driving platform. According to the present disclosure, the pressing structure and the clamping slot structure cooperate to achieve a detachable connection between the supporting platform and the driving platform, thereby facilitating repair and maintenance of the cleaning device.

19 Claims, 16 Drawing Sheets

(58) Field of Classification Search
CPC ..... A47L 11/4038; A47L 11/4041; A47L 11/4052; A47L 11/4058; A47L 11/4066; A47L 2201/06
See application file for complete search history.

(56) References Cited

U.S. PATENT DOCUMENTS

| | | | | |
|---|---|---|---|---|
| 2020/0000302 | A1 | | 1/2020 | Morin et al. |
| 2022/0079406 | A1* | | 3/2022 | Zhang ..... A47L 11/4036 |

FOREIGN PATENT DOCUMENTS

| | | | | | |
|---|---|---|---|---|---|
| CN | 108814458 | A | | 11/2018 | |
| CN | 108836187 | A | | 11/2018 | |
| CN | 109452906 | A | | 3/2019 | |
| CN | 208598297 | U | * | 3/2019 | ..... A47L 11/4041 |
| CN | 209712777 | U | | 12/2019 | |
| CN | 110897556 | A | | 3/2020 | |
| CN | 111345744 | A | | 6/2020 | |
| CN | 111374609 | A | | 7/2020 | |
| CN | 211022430 | U | | 7/2020 | |
| CN | 111588317 | A | * | 8/2020 | ..... A47L 11/40 |
| CN | 112806915 | A | | 5/2021 | |
| CN | 112806916 | A | | 5/2021 | |
| CN | 113679292 | A | | 11/2021 | |
| CN | 215272471 | U | | 12/2021 | |
| CN | 215305507 | U | | 12/2021 | |
| CN | 215959618 | U | | 3/2022 | |
| KR | 20050012047 | A | * | 1/2005 | ..... A47L 5/30 |
| KR | 10-2012-0088314 | A | | 8/2012 | |
| WO | 2020/200328 | A1 | | 10/2020 | |

OTHER PUBLICATIONS

International Search Report and dated May 6, 2022, issued in related International Patent Application No. PCT/CN2022/075597.
Office Action dated Sep. 29, 2021, issued in cooresponding Chinese Patent Application No. 202110186818.7.
Extended European Search Report issued in corresponding European Patent Application No. 22752265.3, dated Dec. 23, 2024.

* cited by examiner

AUTOMATIC CLEANING DEVICE

CROSS-REFERENCE TO RELATED APPLICATION

This application is a U.S. National Stage of International Application No. PCT/CN2022/075594, filed on Feb. 9, 2022, which claims priority over Chinese Patent Application No. 202110186818.7 and No. 202120375551.1, filed on Feb. 10, 2021, both of which are incorporated herein by reference in their entireties.

TECHNICAL FIELD

The present disclosure relates to the field of cleaning robot technologies, and more particularly to an automatic cleaning device.

BACKGROUND

At present, there are mainly two types of cleaning robots, namely, a sweeping robot and a mopping robot. The sweeping robot or the mopping robot each has a single function, and may be only used for sweeping or mopping, respectively. If it is desired to sweep and mop the floor at the same time, both devices have to be prepared, occupying a double space and affecting the disposal of other components due to the unreasonable design of structures.

SUMMARY

An objective of the present disclosure is to provide an automatic cleaning device.

According to a specific embodiment of the present disclosure, an automatic cleaning device is provided, including: a mobile platform configured to move automatically on an operating surface; and a cleaning module arranged on the mobile platform. The cleaning module includes a dry-cleaning module configured to clean at least a part of the operating surface by means of dry cleaning, and a wet-cleaning module configured to clean at least a part of the operating surface by means of wet cleaning. The wet-cleaning module includes a cleaning head configured to clean the operating surface, and a driving unit configured to drive the cleaning head to substantially reciprocate along a target surface. The target surface is a part of the operating surface. The driving unit includes a driving platform and a supporting platform detachably connected to the driving platform.

In some examples, the driving platform includes at least one clamping slot structure; the supporting platform includes at least one pressing structure; wherein the pressing structure and the clamping slot structure cooperate to achieve a detachable connection between the supporting platform and the driving platform.

In some examples, the clamping slot structure includes an accommodating slot configured to accommodate the pressing structure; and a pawl configured to fix the pressing structure when the pressing structure is inserted into the accommodating slot.

In some examples, the clamping slot structure further includes at least one buffer pad located in the accommodating slot and configured to reduce a frictional force between the pressing structure and the accommodating slot.

In some examples, the clamping slot structure further includes a sliding slot formed at an inlet of the clamping slot structure and configured to guide the pressing structure to be inserted into the accommodating slot.

In some examples, the pressing structure includes a pressing structure body matched with the accommodating slot in shape; and a detaching button located within the pressing structure body and cooperating with the pawl to achieve locking.

In some examples, the detaching button includes a locking cavity that cooperates with the pawl to achieve locking; and an elastic cavity that achieves elastic pressing of the detaching button by a built-in spring.

In some examples, the detaching button further includes a pressing surface of a concave-convex structure.

In some examples, the pressing structure body includes a concave part accommodating the pawl.

In some examples, the clamping slot structure is symmetrically arranged on two sides of the driving platform and/or the pressing structure is symmetrically arranged on two sides of the supporting platform.

The present disclosure provides the automatic cleaning device, in which the driving platform is provided with the clamping slot structure and the supporting platform is provided with the pressing structure, so that the pressing structure and the clamping slot structure cooperate to achieve the detachable connection between the supporting platform and the driving platform, thereby facilitating repair and maintenance of the cleaning device.

According to a specific embodiment of the present disclosure, an automatic cleaning device is provided, including: a mobile platform configured to move automatically on an operating surface; and a cleaning module arranged on the mobile platform. The cleaning module includes a dry-cleaning module configured to clean at least a part of the operating surface by means of dry cleaning, and a wet-cleaning module configured to clean at least a part of the operating surface by means of wet cleaning. The wet-cleaning module includes a cleaning head configured to clean the operating surface; a driving unit configured to drive the cleaning head to reciprocate along a target surface, where the target surface is a part of the operating surface; a driving platform connected to a bottom surface of the mobile platform and configured to provide a driving force; and a supporting platform detachably connected to the driving platform and configured to support the cleaning head. The supporting platform is provided with a clamping slot in which a cleaning substrate corresponding to the clamping slot is arranged. The cleaning substrate and the clamping slot cooperate to enable the cleaning head to move within the supporting platform in a direction of the clamping slot.

In some examples, an elastic bracket is arranged between the cleaning substrate and the supporting platform and configured to limit a direction of movement of the cleaning substrate.

In some examples, the elastic bracket includes a first end part and a second end part, and a connecting part for connecting the first end part to the second end part.

In some examples, the connecting part is provided with a mounting part for securing the elastic bracket to the clamping slot.

In some examples, the first end part and the second end part of the elastic bracket are located on two sides of the cleaning substrate, respectively, and are configured to limit a direction of travel of the cleaning substrate.

In some examples, elastic pads are arranged between the first end part and the cleaning substrate, as well as between the second end part and the cleaning substrate, and are configured to enable the cleaning substrate to reset elastically after the cleaning substrate is in contact with the elastic pads in a process of reciprocating motion.

In some examples, a third end part and a fourth end part are arranged at two ends of the clamping slot, respectively, and are configured to limit a region of reciprocating motion of the cleaning head.

In some examples, buffer pads are arranged on sides of the third end part and the fourth end part that face the cleaning substrate.

In some examples, the driving platform includes a motor arranged on a side of the driving platform close to the mobile platform and configured to output power by a motor output shaft; a driving wheel connected to the motor output shaft and being of an asymmetric structure; and a vibrating rod arranged on a side of the driving platform opposite to the motor, connected to the driving wheel, and configured to reciprocate under asymmetrical rotation of the driving wheel.

In some examples, the cleaning substrate includes an assembly notch formed where the cleaning substrate is in contact with the vibrating rod, the vibrating rod is assembled in the assembly notch where the supporting platform is connected to the driving platform, and the cleaning head reciprocates in the clamping slot under the action of the vibrating rod.

The present disclosure provides the automatic cleaning device, in which the supporting platform is provided with the clamping slot, the cleaning substrate corresponding to the clamping slot is arranged in the clamping slot, and the cleaning substrate and the clamping slot cooperate to enable the cleaning head to move within the supporting platform in a direction of the clamping slot. Therefore, a region of movement of the cleaning head is limited, and a region of mopping of the cleaning head is further limited, thereby avoiding reducing the cleaning effect due to an extremely large region of mopping.

BRIEF DESCRIPTION OF THE DRAWINGS

The accompanying drawings here, which are incorporated in the specification and constitute a part of the specification, show embodiments conforming to the present disclosure, and are used to explain the principles of the present disclosure together with the specification. Apparently, the accompanying drawings in the following description are only some embodiments of the present disclosure, and for those of ordinary skills in the art, other drawings may also be obtained from these accompanying drawings without creative efforts. In the accompanying drawings.

LIST OF REFERENCE NUMERALS

Figure 1:
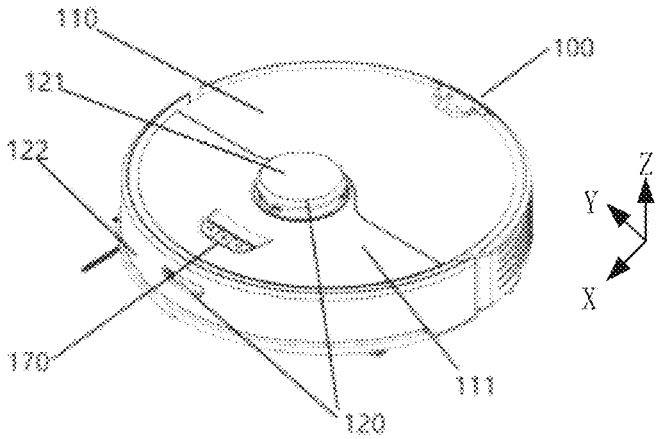
FIG. 1 is an oblique view of an automatic cleaning device according to an embodiment of the present disclosure.

100—mobile platform, 110—rearward portion, 111—forward portion, 120—perception system, 121—position determining device, 122—buffer, 123—cliff sensor, 130—control system, 140—driving system, 141—driving wheel assembly, 142—steering assembly, 143—elastic element, 146—driving motor, 150—cleaning module, 151—dry-cleaning module, 152—dust box, 153—filter, 154—dust suction inlet, 155—air outlet, 156—blower, 160—energy system, 170—human-computer interaction system, 400—wet-cleaning module, 410—cleaning head, 420—driving unit, 421—driving platform, 422—supporting platform, 4211—motor, 4212—driving wheel, 4213—vibrating member, 4214—connecting rod, 4215—vibration buffering device, 4216—pawl, 4218—clean water pump pipe, 4219—clean water pump, 4221—cleaning substrate, 4229—elastic detaching button, 4224—assembly region, 4225—engagement position, 4222—first sliding slot, 4223—second sliding slot, 422001—clamping slot, 422002—elastic bracket, 4220021—first end part, 4220022—second end part, 4220023—connecting part, 4220025—third end part, 4220026—fourth end part, 525—first slider, 528—second slider, 512 (4227)—rotary end, 514 (4226)—sliding end, 516 (624)—first pivot, 518 (626)—second pivot, 5000 (900, 700)—driving mechanism, 500—four-link lifting structure, 501—first connecting end, 502—second connecting end, 5011—first bracket, 5012—first connecting rod pair, 50121—first connecting rod, 50122—second connecting rod, 42194—cable, 50131—cable motor terminal, 50132—cable bracket terminal, 50111—cross beam, 50112—sliding slot, 50113—clamping hole, 50114—first longitudinal beam, 50115—second longitudinal beam, 5021—second bracket, 5022—second connecting rod pair, 50221—third connecting rod, and 50222—fourth connecting rod.

DETAILED DESCRIPTION

To make the objectives, technical solutions and advantages of the present disclosure clearer, the present disclosure will be further described in detail below with reference to the accompanying drawings. It is obvious that the described embodiments are only some, but not all, of the embodiments of the present disclosure. All other embodiments obtained by those of ordinary skills in the art without creative efforts based on the embodiments in the present disclosure are within the protection scope of the present disclosure.

The terms used in the embodiments of the present disclosure are for the purpose of describing particular embodiments only and are not intended to limit the present disclosure. The singular forms "a/an", "said" and "the" used in the embodiments of the present disclosure and the appended claims are intended to include the plural forms as well, unless otherwise indicated clearly in the context. The term "a plurality of" generally includes at least two.

It is to be understood that the term "and/or" used herein only describes an association relationship between associated objects, and indicates that there may be three kinds of relationships. For example, A and/or B may indicate three cases: A exists alone, A and B exist at the same time, and B exists alone. In addition, the character "/" herein generally indicates an "or" relationship between the contextual objects.

It is to be understood that, although the terms first, second, third, etc. may be used to describe in the embodiments of the present disclosure, these should not be limited to these terms. These terms are only used to distinguish. For example, "first" may also be referred to as "second" without departing from the scope of the embodiments of the present disclosure. Similarly, "second" may also be referred to as "first".

It is also to be noted that the terms "including", "containing", or any other variants are intended to cover the nonexclusive inclusion, so that a commodity or device including a series of elements includes not only those elements, but also other elements not listed explicitly or elements inherent to such a commodity or device. Without more limitations, the element defined by the phrase "including a . . . " does not exclude the existence of other same elements in the commodity or device including the element.

In the related art, in order to achieve integrated cleaning of floor sweeping and mopping, the sweeping robot and the mopping robot may also be combined, and a mopping cloth is added at the end of the robot. However, a mopping module in the integrated cleaning cannot be lifted, lowered or disassembled, leading to inconvenience in use and maintenance.

Furthermore, in the related art, during a working process of an integrated sweeping and mopping cleaning device, since the width of the mopping cloth is always equivalent to that of the bottom surface of the cleaning device while the width of a dry sweeping device is smaller than that of the bottom surface of the cleaning device, the width of the mopped floor by the mopping cloth is larger than that of the swept floor. As a result, some floor regions are mopped before being swept, and consequently, the floor becomes dirtier. Thus, it is necessary to limit a cleaning region of the wet mopping cloth.

Optional embodiments of the present disclosure are described in detail below with reference to the accompanying drawings.

Figure 2:
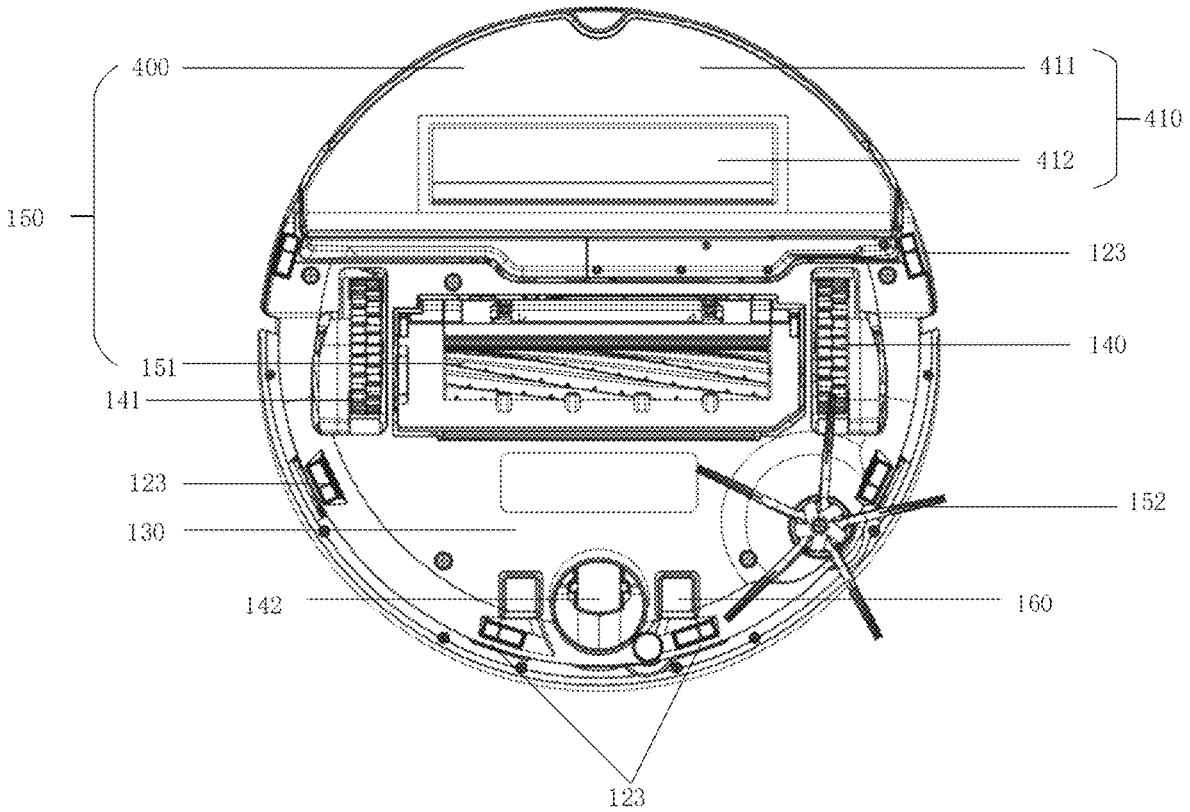
FIG. 2 is a schematic diagram of a bottom structure of an automatic cleaning device according to an embodiment of the present disclosure.

FIG. 1 and FIG. 2 are schematic structural diagrams of an automatic cleaning device according to an exemplary embodiment. As shown in FIG. 1 and FIG. 2, the automatic cleaning device may be a robot vacuum cleaner, or may be a mopping/brushing robot, or may be a window climbing robot, or the like. The automatic cleaning device may include a mobile platform 100, a perception system 120, a control system 130, a driving system 140, a cleaning module 150, an energy system 160 and a human-computer interaction system 170.

The mobile platform 100 may be configured to move automatically along a target direction on an operating surface. The operating surface may be a surface to be cleaned by the automatic cleaning device. In some embodiments, the automatic cleaning device may be a mopping robot, and thus the automatic cleaning device operates on a floor, and the floor is the operating surface. The automatic cleaning device may also be a window cleaning robot, and thus the automatic cleaning device operates on an outer surface of glass of a building, and the glass is the operating surface. The automatic cleaning device may also be a pipe cleaning robot, and thus the automatic cleaning device operates on an inner surface of a pipe, and the inner surface of the pipe is the operating surface. For the purpose of presentation only, the following description in the present application takes a mopping robot as an example for illustration.

In some embodiments, the mobile platform 100 may be an autonomous mobile platform, or a non-autonomous mobile platform. When the mobile platform 100 is the autonomous mobile platform, the mobile platform 100 itself can automatically and adaptively make an operational decision based on an unexpected environmental input; and the non-autonomous mobile platform itself cannot adaptively make an operational decision based on an unexpected environmental input, but can execute a given procedure or operate according to a certain logic. Correspondingly, when the mobile platform 100 is the autonomous mobile platform, the target direction may be determined autonomously by the automatic cleaning device; and when the mobile platform 100 is the non-autonomous mobile platform, the target direction may be set systematically or manually. When the mobile platform 100 is the autonomous mobile platform, the mobile platform 100 includes a forward portion 111 and a rearward portion 110.

The perception system 120 includes a position determining device 121 located above the mobile platform 100, a buffer 122 located in the forward portion 111 of the mobile platform 100, and sensing devices located at a bottom of the mobile platform. For example, the sensing devices include cliff sensors 123 and an ultrasonic sensor (not shown), an infrared sensor (not shown), a magnetometer (not shown), an accelerometer (not shown), a gyroscope (not shown), an odometer (not shown), and the like, for providing various position information and motion state information of the automatic cleaning device to the control system 130.

In order to describe behaviors of the automatic cleaning device more clearly, directions are defined as follows: the automatic cleaning device may travel on the floor by various combinations of movements relative to the following three mutually perpendicular axes defined by the mobile platform 100, i.e., a transversal axis X, a front and rear axis Y and a center vertical axis Z. A forward driving direction along the front and rear axis Y is designated as "forward", and a rearward driving direction along the front and rear axis Y is designated as "rearward". The transversal axis X substantially extends between a right wheel and a left wheel of the automatic cleaning device along an axis center defined by a center point of a driving wheel assembly 141. The automatic cleaning device may rotate around the X axis. It is referred to as "pitch up" when the forward portion of the automatic cleaning device is tilted upward and the rearward portion thereof is tilted downward, and it is referred to as "pitch down" when the forward portion of the automatic cleaning device is tilted downward and the rearward portion thereof is tilted upward. In addition, the automatic cleaning device may rotate around the Z axis. In a forward direction of the automatic cleaning device, it is referred to as "turn right" when the automatic cleaning device is tilted to the right of the Y axis, and it is referred to as "turn left" when the automatic cleaning device is tilted to the left of the Y axis.

As shown in FIG. 2, the cliff sensors 123 are arranged at the bottom of the mobile platform 100 and in front of and behind the driving wheel assembly 141 and configured to prevent the automatic cleaning device that is moving back from falling off, so as to protect the automatic cleaning device against damages. The aforementioned "front" refers to the same side with respect to the traveling direction of the automatic cleaning device, and the aforementioned "behind" refers to the opposite side with respect to the traveling direction of the automatic cleaning device.

The position determining device 121 includes, but is not limited to, a camera and a laser distance sensor (LDS).

The various components in the perception system 120 may work independently or jointly to achieve intended functions more accurately. The surface to be cleaned is identified by the cliff sensor 123 and the ultrasonic sensor, so that the physical characteristics including surface materials, the degree of cleanliness, etc. of the surface to be cleaned are determined, and a more accurate judgment can be made with the help of the camera, the laser distance sensor, etc.

For example, the ultrasonic sensor may determine whether the surface to be cleaned is a carpet. If the ultrasonic sensor determines that the surface to be cleaned is made of a carpet material, the control system 130 controls the automatic cleaning device to perform cleaning in a carpet mode.

The forward portion 111 of the mobile platform 100 is provided with the buffer 122. During cleaning, when the driving wheel assembly 141 propels the automatic cleaning device to travel on the floor, the buffer 122 detects one or more events (or objects) in a travelling path of the automatic cleaning device via a sensor system, e.g., an infrared sensor, and the automatic cleaning device may control the driving wheel assembly 141 based on the event (or object), such as obstacle and wall, detected by the buffer 122 to cause the automatic cleaning device to respond to the event (or object), for example, to move away from the obstacle.

The control system 130 is arranged on a main circuit board in the mobile platform 100, and includes a computing processor such as a central processing unit and an application processor that communicates with a non-transitory memory such as a hard disk, a flash memory and a random-access memory. The application processor is configured to receive environmental information sensed by the plurality of sensors and transmitted from the perception system 120, to draw a simultaneous map of an environment where the automatic cleaning device is located using a positioning algorithm, e.g., simultaneous localization and mapping (SLAM), based on obstacle information fed back by the LDS, and to autonomously determine a travelling path based on the environmental information and the environmental map, and then to control the driving system 140 to perform operations, such as travelling forward, travelling backward, and/or steering based on the autonomously determined travelling path. Further, the control system 130 may also determine whether to activate the cleaning module 150 to perform a cleaning operation based on the environmental information and the environmental map.

Specifically, the control system 130 may, based on distance information and speed information which are fed back by the buffer 122, the cliff sensors 123 and the sensing devices such as the ultrasonic sensor, the infrared sensor, the magnetometer, the accelerometer, the gyroscope and the odometer, comprehensively determine a current operational state of the sweeping robot, such as crossing a threshold, getting on a carpet, locating at an edge of a cliff, being stuck from above or below, dust box being full or being picked up, and will also give specific next-step action strategies for different situations, so that the operation of the automatic cleaning device is more in line with requirements of an owner and provides better user experience. Further, the control system can plan the most efficient and reasonable cleaning path and cleaning mode based on the simultaneous map drawn by the SLAM, thereby greatly improving the cleaning efficiency of the automatic cleaning device.

Figure 3:
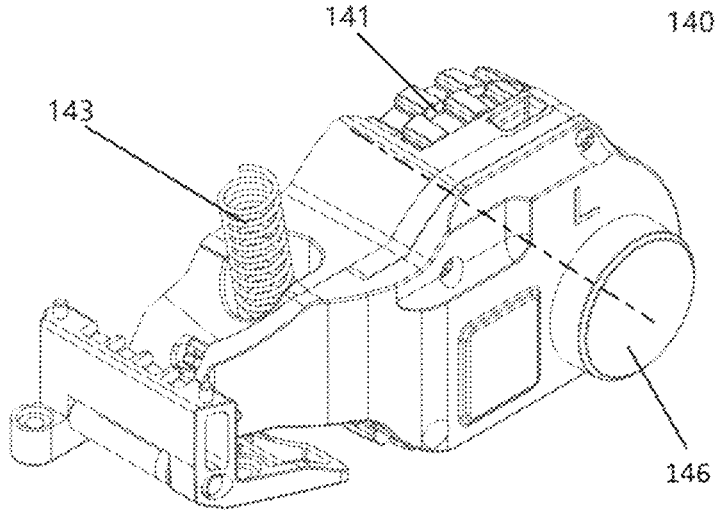
FIG. 3 is an oblique view of a driving wheel assembly on one side according to an embodiment of the present disclosure.
Figure 4:
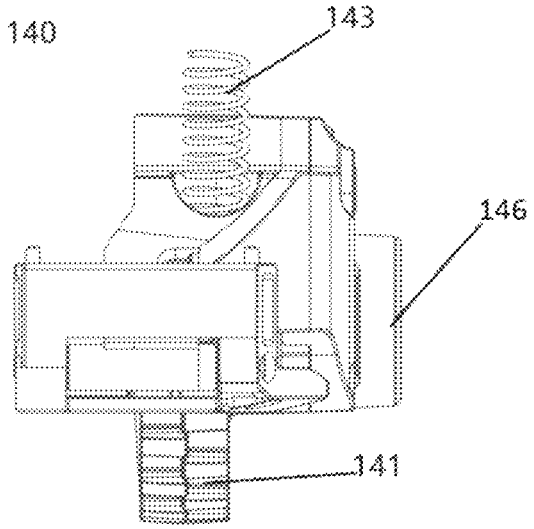
FIG. 4 is a front view of the driving wheel assembly on one side according to an embodiment of the present disclosure.

The driving system 140 may control the automatic cleaning device to run across the floor by executing a driving command based on specific distance and angle information, such as x, y and θ components. As shown in FIG. 3 and FIG. 4, which are respectively an oblique view and a front view of driving wheel assembly 141 on one side according to an embodiment of the present disclosure. As shown in these drawings, the driving system 140 includes a driving wheel assembly 141 and may control a left wheel and a right wheel simultaneously. In order to control the movement of the machine more accurately, the driving system 140 preferably includes a left driving wheel assembly and a right driving wheel assembly that are symmetrically arranged along a lateral axis defined by the mobile platform 100. The driving wheel assembly includes a body part, a driving wheel and an elastic element. One end of the body part is connected to a rack. The driving wheel is arranged on the body part and driven by a driving motor 146. The elastic element is connected between the body part and the rack, and is configured to provide an elastic force between the rack and the body part. The driving motor 146 is located on the outer side of the driving wheel assembly 141, and an axis center of the driving motor 146 is located within a cross-sectional projection of the driving wheel. The driving wheel assembly 141 may also be connected to a circuit for measuring driving current and an odometer.

In order for the automatic cleaning device to move on the floor more stably or have a stronger movement ability, the automatic cleaning device may include one or more steering assemblies 142, wherein the steering assembly 142 may be a driven wheel or a driving wheel, and structurally includes but is not limited to a universal wheel. The steering assembly 142 may be located in front of the driving wheel assembly 141.

The driving motor 146 provides power for rotation of the driving wheel assembly 141 and/or the steering assembly 142.

The driving wheel assembly 141 may be detachably connected to the mobile platform 100 to facilitate assembly, disassembly and maintenance. The driving wheel may have an offset drop suspension system movably fastened, e.g., rotatably attached, to the mobile platform 100 of the automatic cleaning device, and maintain contact and traction with the floor by an elastic element 143 such as a tension spring or a compression spring with a certain landing force; meanwhile, the cleaning module 150 of the automatic cleaning device is also in contact with the surface to be cleaned with a certain pressure.

The energy system 160 includes a rechargeable battery, such as a nickel-hydride battery and a lithium battery. The rechargeable battery may be connected with a charging control circuit, a battery pack charging temperature detecting circuit and a battery undervoltage monitoring circuit, wherein the charging control circuit, the battery pack charging temperature detecting circuit and the battery undervoltage monitoring circuit are then connected to a single-chip microcomputer control circuit. A host of the automatic cleaning device is connected to a charging pile through a charging electrode disposed on a side of or below a body of the automatic cleaning device for charging.

The human-computer interaction system 170 includes buttons that are on a panel of the host and used by a user to select functions. The human-computer interaction system 170 may further include a display screen and/or an indicator light and/or a horn that present a current state or function item of the automatic cleaning device to the user. The human-computer interaction system 170 may further include a mobile client program. For a route navigation type cleaning device, the mobile client may present a map of the environment where the device is located and a position of the device to the user, which may provide richer and more user-friendly function items to the user.

The cleaning module 150 may include a dry-cleaning module 151 and/or a wet-cleaning module 400.

As shown in FIG. 5 to FIG. 8, the dry-cleaning module 151 includes a rolling brush, a dust box, a blower and an air outlet. The rolling brush having a certain interference with the floor sweeps up garbage on the floor and rolls up the garbage to the front of a dust suction inlet between the rolling brush and the dust box, and then the garbage is sucked into the dust box by air having a suction force, which is generated by the blower and passes through the dust box. A dust removal ability of the sweeping robot may be characterized by a dust pickup efficiency (DPU) of the garbage. The DPU is affected by a structure and material of the rolling brush, by a utilization rate of the air in an air channel formed by the dust suction inlet, the dust box, the blower, the air outlet and connecting components among the four, and by a type and power of the blower, which is a complex systematic design problem. Compared to an ordinary plug-in vacuum cleaner, the improvement of the dust removal ability is more meaningful for an automatic cleaning device with limited energy because the improvement of the dust removal ability directly and effectively reduces requirements for energy, that is, the original cleaning device that may clean 80 square meters of the floor on a single charge may be evolved to clean 180 square meters or more on a single charge. Furthermore, the service life of the battery with the reduced number of charging times will also be greatly increased, so that the frequency of replacing the battery by the user will also be decreased. More intuitively and importantly, the improvement of the dust removal ability is the most obvious and important user experience, as the user will directly observe whether the thorough cleaning is achieved. The dry-cleaning module may further include a side brush having a rotary shaft angled relative to the floor, for moving debris into a region of the rolling brush of the cleaning module 150.

Figure 5:
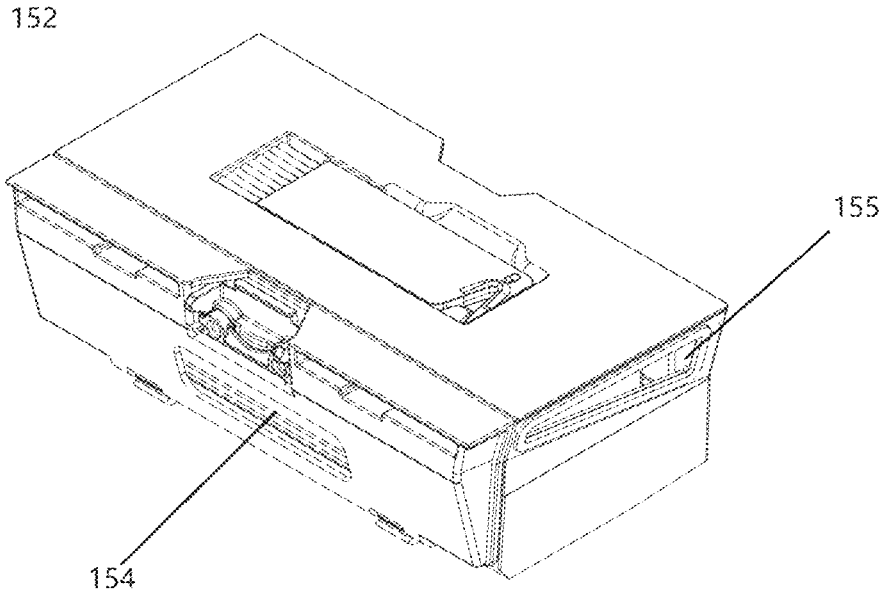
FIG. 5 is an oblique view of a dust box according to an embodiment of the present disclosure.
Figure 6:
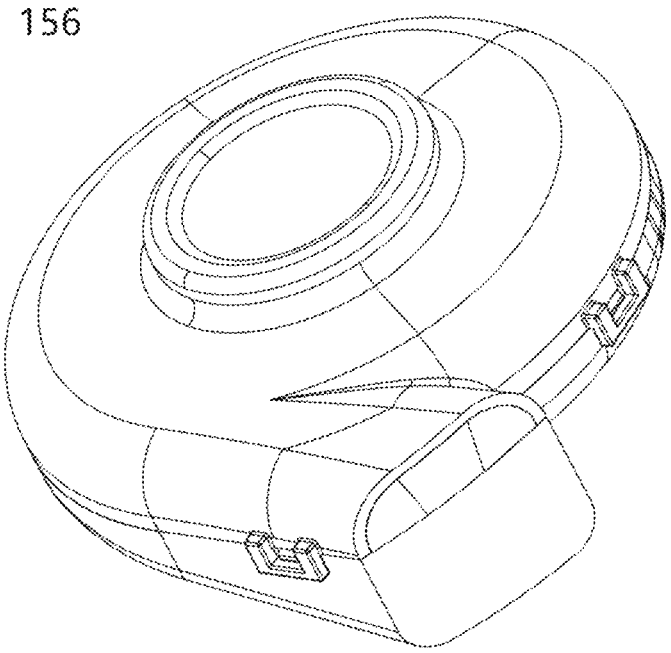
FIG. 6 is an oblique view of a blower according to an embodiment of the present disclosure.
Figure 7:
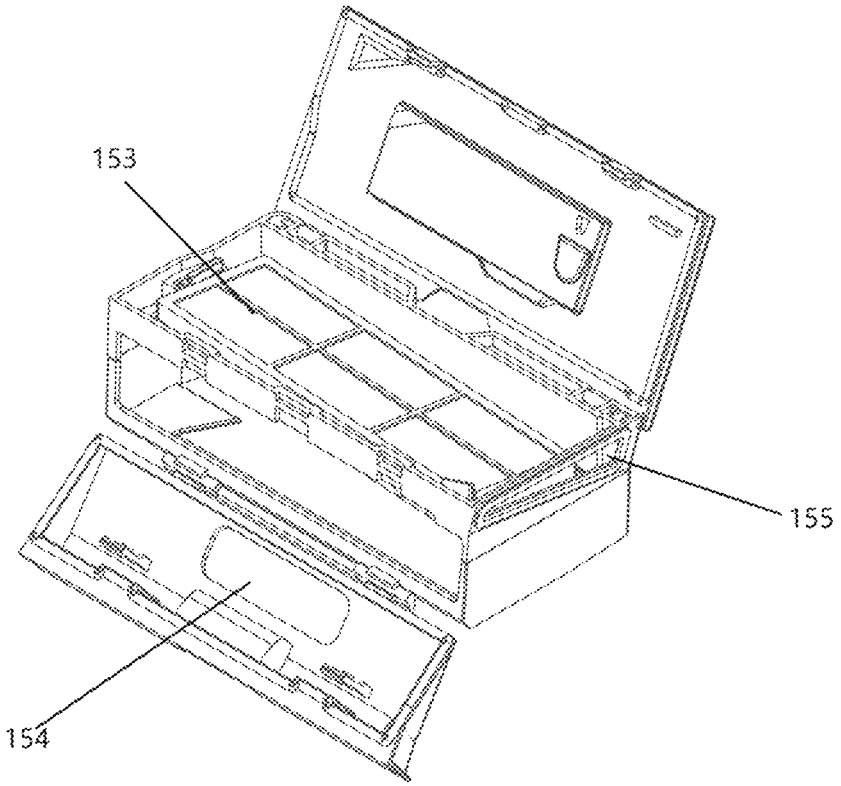
FIG. 7 is a schematic diagram of a dust box in an open state according to an embodiment of the present disclosure.
Figure 8:
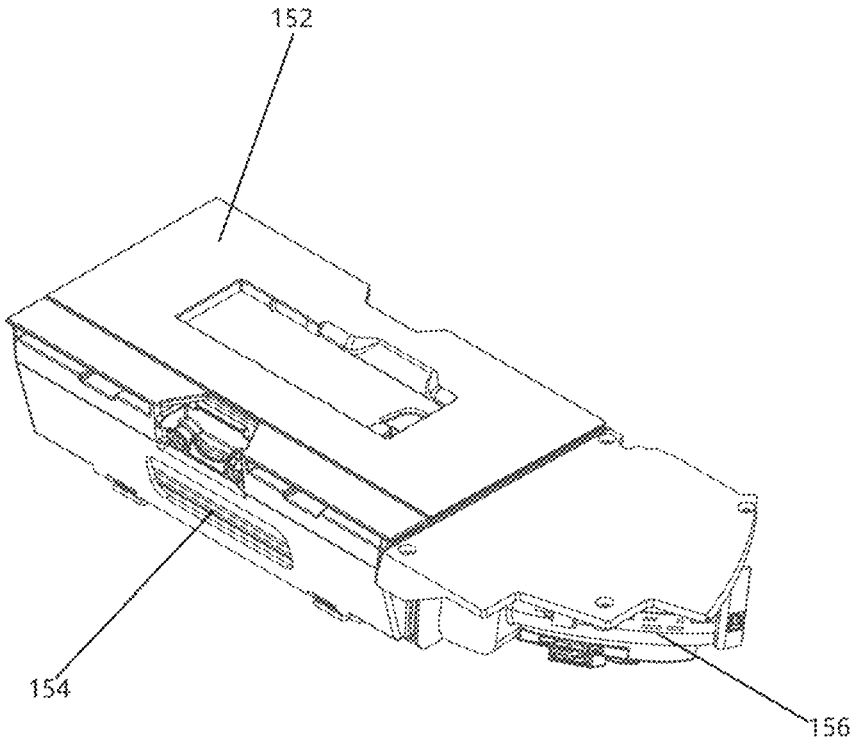
FIG. 8 is a schematic diagram of a dust box and a blower in an assembled state according to an embodiment of the present disclosure.

FIG. 5 is a schematic structural diagram of a dust box 152 in the dry-cleaning module, FIG. 6 is a schematic structural diagram of a blower 156 in the dry-cleaning module, FIG. 7 is a schematic diagram of the dust box 152 in an open state, and FIG. 8 is a schematic diagram of the dust box and the blower in an assembled state.

The rolling brush having a certain interference with the floor sweeps up garbage on the floor and rolls up the garbage to the front of the dust suction inlet 154 between the rolling brush and the dust box 152, and then the garbage is sucked into the dust box 152 by air having a suction force, which is generated by the blower 156 and passes through the dust box 152. The garbage is isolated inside the dust box 152 close to the dust suction inlet 154 by a filter 153, and the filter 153 completely isolates the dust suction inlet from the air outlet, so that the filtered air enters the blower 156 through the air outlet 155.

Typically, the dust suction inlet 154 of the dust box 152 is located in front of the automatic cleaning device, the air outlet 155 is located on a side of the dust box 152, and an air inlet of the blower 156 is docked with the air outlet of the dust box.

A front panel of the dust box 152 may be opened for cleaning the garbage in the dust box 152.

The filter 153 is detachably connected to a body of the dust box 152 to facilitate the removal and cleaning of the filter.

Figure 9:
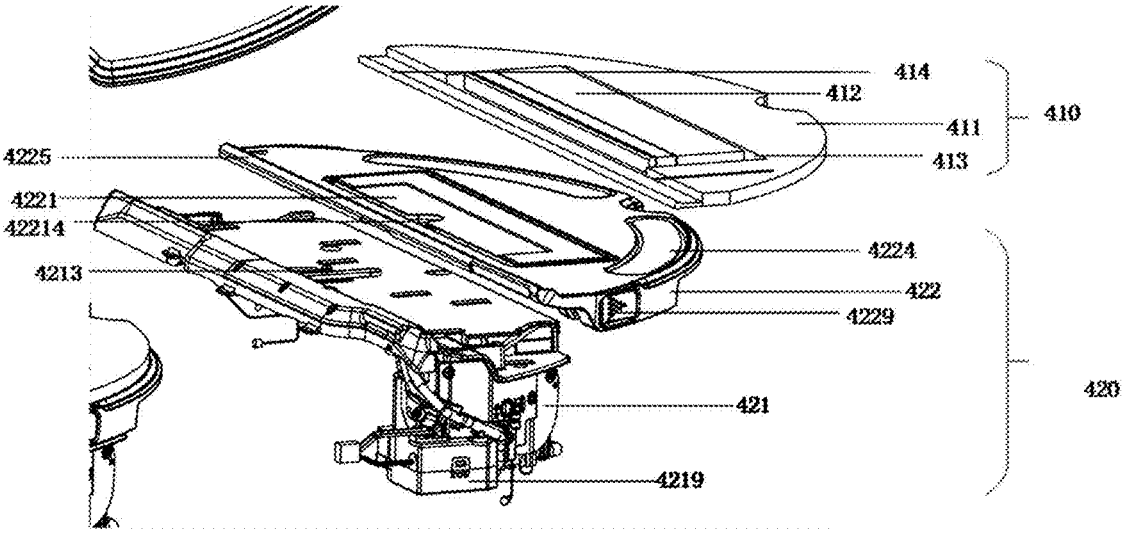
FIG. 9 is an exploded diagram of an automatic cleaning device according to an embodiment of the present disclosure.
Figure 10:
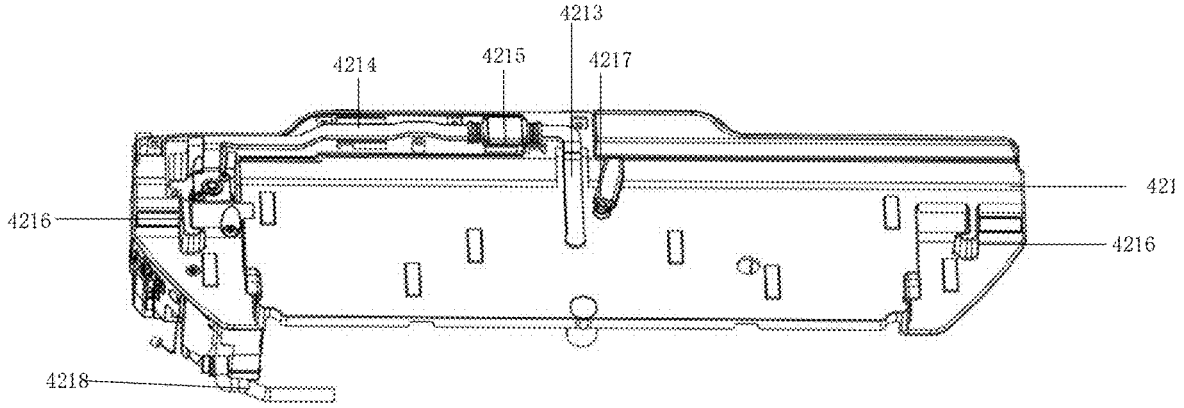
FIG. 10 is a structural diagram of a supporting platform of an automatic cleaning device according to an embodiment of the present disclosure.
Figure 11:
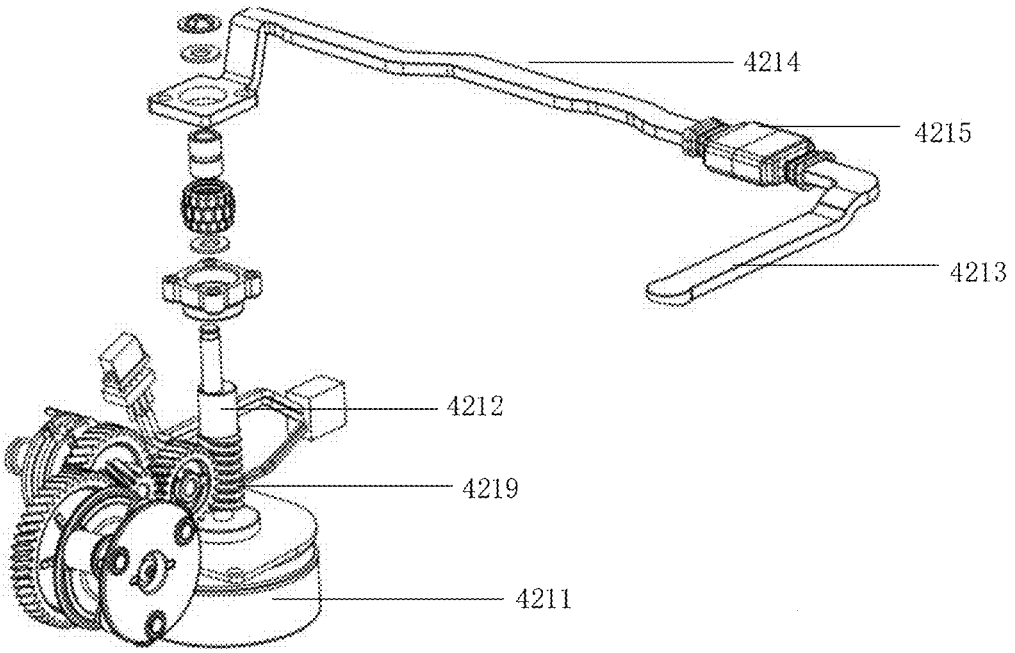
FIG. 11 is a structural diagram of a vibrating member of an automatic cleaning device according to an embodiment of the present disclosure.

According to a specific embodiment of the present disclosure, as shown in FIG. 9 to FIG. 11, the wet-cleaning module 400 according to the present disclosure is configured to clean at least a part of the operating surface by means of wet cleaning. The wet-cleaning module 400 includes a cleaning head 410 and a driving unit 420. The cleaning head 410 is configured to clean at least a part of the operating surface, and the driving unit 420 is configured to drive the cleaning head 410 to substantially reciprocate along a target surface, the target surface being a part of the operating surface. The cleaning head 410 reciprocates along a surface to be cleaned, and a surface of the cleaning head 410 in contact with the surface to be cleaned is provided with a cleaning cloth or a cleaning plate, which generates a high-frequency friction with the surface to be cleaned through reciprocating motion, thereby removing stains on the surface to be cleaned.

The higher the friction frequency, the more friction times per unit time. A high-frequency reciprocating motion, also referred to as reciprocating vibration, has a much higher cleaning ability than an ordinary reciprocating motion, e.g., rotational friction cleaning. In some examples, when the friction frequency approaches a sound wave, the cleaning effect will be much higher than that of the rotational friction cleaning of dozens of revolutions per minute. Additionally, tufts on the surface of the cleaning head are more uniform and extend in the same direction under the shaking of high-frequency vibration so as to achieve a more uniform overall cleaning effect, rather than being only applied with a down pressure to increase the frictional force in the case of low-frequency rotation so as to improve the cleaning effect, as only the down pressure does not cause the tufts to extend in the nearly same direction. Therefore, in terms of the effect, water marks on the operating surface cleaned under the high-frequency vibration are more uniform without chaotic water stains.

The reciprocating motion may be a repeated motion along any one or more directions within the operating surface, or may be a vibrating motion perpendicular to the operating surface, which is not strictly limited. In some examples, the direction of the reciprocating motion of the cleaning module is substantially perpendicular to the travelling direction of the automatic cleaning device because the direction of the reciprocating motion being parallel to the travelling direction of the automatic cleaning device may cause the automatic cleaning device itself, which is travelling, to be unstable for the reason that thrust and resistance in the travelling direction make it easy for the driving wheel to skid, and the effect of skid is more obvious when the wet-cleaning module is included, as the wetness of the operating surface increases the possibility of skid. The skid not only affects the stable travelling of the automatic cleaning device for cleaning, but also causes the sensors such as the odometer and the gyroscope to measure a distance inaccurately, thereby resulting in the inability of the navigation type automatic cleaning device to locate and draw a map accurately. In the case of frequent skid, the effect on the SLAM cannot be ignored. Therefore, it is necessary to avoid the skid of the automatic cleaning device as much as possible. In addition to skid, a motion component of the cleaning head in the travelling direction of the automatic cleaning device causes the automatic cleaning device to be pushed forward and backward constantly during travelling, so the automatic cleaning device cannot travel stably and smoothly.

As an optional embodiment of the present disclosure, as shown in FIG. 9, the driving unit 420 includes a driving platform 421 connected to a bottom surface of the mobile platform 100 for providing a driving force; and a supporting platform 422 detachably connected to the driving platform 421, for supporting the cleaning head 410 and being able to lift and lower under the driving of the driving platform 421.

As an optional embodiment of the present disclosure, a lifting module is provided between the cleaning module 150 and the mobile platform 100, so that the cleaning module 150 may be in better contact with the surface to be cleaned, or different cleaning strategies may be used for surfaces to be cleaned made of different materials.

In some examples, the dry-cleaning module 151 may be connected to the mobile platform 100 by a passive lifting module. When the cleaning device encounters an obstacle, the dry-cleaning module 151 may pass the obstacle more easily through the lifting module.

In some examples, the wet-cleaning module 400 may be connected to the mobile platform 100 by an active lifting module. When the wet-cleaning module 400 does not participate in the operation temporarily, or when a surface to be cleaned cannot be cleaned by the wet-cleaning module 400, the wet-cleaning module 400 is lifted by the active lifting module and separated from the surface to be cleaned, so as to achieve the change of cleaning means.

As shown in FIG. 10 and FIG. 11, the driving platform 421 includes a motor 4211 disposed on a side of the driving platform 421 close to the mobile platform 100 and for outputting power through a motor output shaft; a driving wheel 4212 connected to the motor output shaft and having an asymmetric structure; and a vibrating member 4213 disposed on a side of the driving platform 421 opposite to the motor 4211 and connected to the driving wheel 4212 to reciprocate under the asymmetrical rotation of the driving wheel 4212.

The driving platform 421 may further include a gear mechanism. The motor 4211 and the driving wheel 4212 are connected through the gear mechanism. The motor 4211 may directly drive the driving wheel 4212 to swivel, or may indirectly drive the driving wheel 4212 to swivel through the gear mechanism. Those of ordinary skills in the art may understand that the gear mechanism may be one gear, or may be a gear set composed of a plurality of gears.

The motor 4211 simultaneously transmits, through a power transmission device, power to the cleaning head 410, the driving platform 421, the supporting platform 422, a water delivery mechanism, a water tank, and the like. The energy system 160 provides power and energy for the motor 4211 and is entirely controlled by the control system 130. The power transmission device may be a gear drive, a chain drive, a belt drive, or may be a worm gear, or the like.

The motor 4211 has a forward output mode and a reverse output mode. In the forward output mode, the motor 4211 rotates in the forward direction; and in the reverse output mode, the motor 4211 rotates in the reverse direction. In the forward output mode of the motor 4211, the motor 4211 simultaneously drives, through the power transmission device, the vibrating member 4213 of the driving platform in the wet cleaning assembly 400 to substantially reciprocate and the water delivery mechanism to move synchronously. In the reverse output mode of the motor 4211, the motor 4211 drives the driving platform 421 to lift and lower through the power transmission device.

Further, the driving platform 421 further includes a connecting rod 4214 extending along an edge of the driving platform 421 and connecting the driving wheel 4212 and the vibrating member 4213, so that the vibrating member 4213 extends to a preset position. An extending direction of the vibrating member 4213 is perpendicular to the connecting rod 4214, so that a reciprocating motion direction of the vibrating member 4213 is substantially perpendicular to the travelling direction of the automatic cleaning device.

Figure 15:
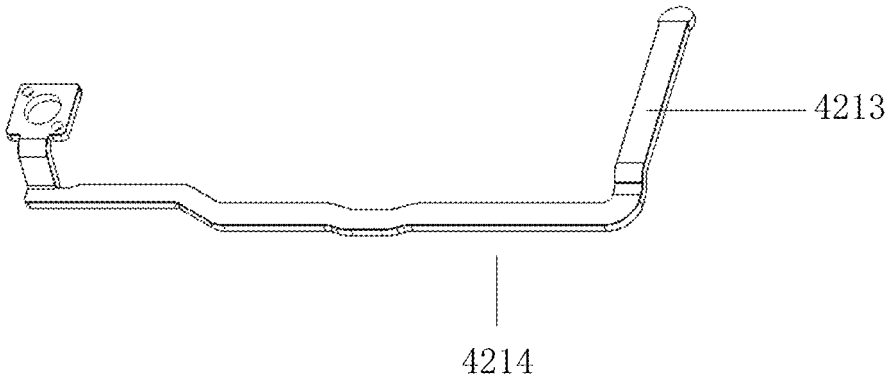
FIG. 15 is a structural diagram of a vibrating member according to an embodiment of the present disclosure.

The motor 4211 is connected to the driving wheel 4212, the vibrating member 4213, the connecting rod 4214 and a vibration buffering device 4215 through the power transmission device. The vibrating member 4213 and the connecting rod 4214 constitute an approximate L-shaped structure, as shown in FIG. 15. The vibrating member 4213 reciprocates under the driving of the connecting rod 4214. The vibration buffering device 4215 has functions of damping and reducing the shaking of a motion behavior driven by the driving wheel 4212, so that the vibrating member 4213 may vibrate stably within a range of motion provided by the supporting platform 422. In some examples, the vibration buffering device 4215 is made of a soft material, in some examples a rubber structure, and the vibration buffering device 4215 is sleeved on the connecting rod 4214. On the other hand, the vibration buffering device 4215 may also protect the vibrating member 4213 from being damaged due to the collision with the driving platform 421, and thus may also affect the reciprocating motion of the vibrating member 4213. Movable components and fixed components of the driving platform 421 are restricted from moving in the travelling direction of the automatic cleaning device through connections with less elasticity, and are connected flexibly and allowed to move in the direction substantially perpendicular to the travelling direction, that is, in a vibration direction of the vibrating member 4213. The above two movement restrictions cause the vibrating member 4213 to substantially reciprocate rather than accurately reciprocate. When the wet cleaning assembly 400 is activated, the motor 4211 is started to rotate forward to drive the connecting rod 4214 through the driving wheel 4212 to reciprocate along the surface of the driving platform 421; meanwhile, the vibration buffering device 4215 drives the vibrating member 4213 to substantially reciprocate along the surface of the driving platform 421, the vibrating member 4213 drives a cleaning substrate 4221 to substantially reciprocate along the surface of the supporting platform 422, and the cleaning substrate 4221 drives a movable region 412 to substantially reciprocate along the surface to be cleaned. At this time, a clean water pump enables clean water to flow out of a clean water tank and sprinkles the clean water on the cleaning head 410 through a water discharging device 4217, and the cleaning head 410 reciprocates to clean the surface to be cleaned.

The cleaning intensity/efficiency of the automatic cleaning device may also be automatically and dynamically adjusted according to an operation environment of the automatic cleaning device. For example, the automatic cleaning device may achieve dynamic adjustment according to physical information of the surface to be cleaned detected by the perception system 120. For example, the perception system 120 may detect the flatness of the surface to be cleaned, a material of the surface to be cleaned, the existence of oil and dust, and other information, and transmit the information to the control system 130 of the automatic cleaning device. Correspondingly, the control system 130 may instruct the automatic cleaning device to automatically and dynamically adjust a rotational speed of the motor and a transmission ratio of the power transmission device according to the operation environment of the automatic cleaning device, so as to adjust a preset reciprocating period of the reciprocating motion of the cleaning head 410.

For example, when the automatic cleaning device operates on a flat floor, the preset reciprocating period may be automatically and dynamically adjusted to be longer, and a water volume of the water pump may be automatically and dynamically adjusted to be smaller; and when the automatic cleaning device operates on a less flat floor, the preset reciprocating period may be automatically and dynamically adjusted to be shorter, and the water volume of the water pump may be automatically and dynamically adjusted to be larger. This is because it is easier to clean the flat floor than the less flat floor, and thus faster reciprocating motion (i.e., a higher frequency) of the cleaning head 410 and larger water volume are needed for cleaning an uneven floor.

For another example, when the automatic cleaning device operates on a table, the preset reciprocating period may be automatically and dynamically adjusted to be longer, and the water volume of the water pump may be automatically and dynamically adjusted to be smaller; and when the automatic cleaning device 100 operates on a floor, the preset reciprocating period may be automatically and dynamically adjusted to be shorter, and the water volume of the water pump may be automatically and dynamically adjusted to be larger. This is because the table has less dust and oil compared to the floor, the material of the table is also easier to clean, and thus, the table can be cleaned with fewer number of reciprocating motions of the cleaning head 410 and relatively smaller water volume of the water pump.

Figure 16:
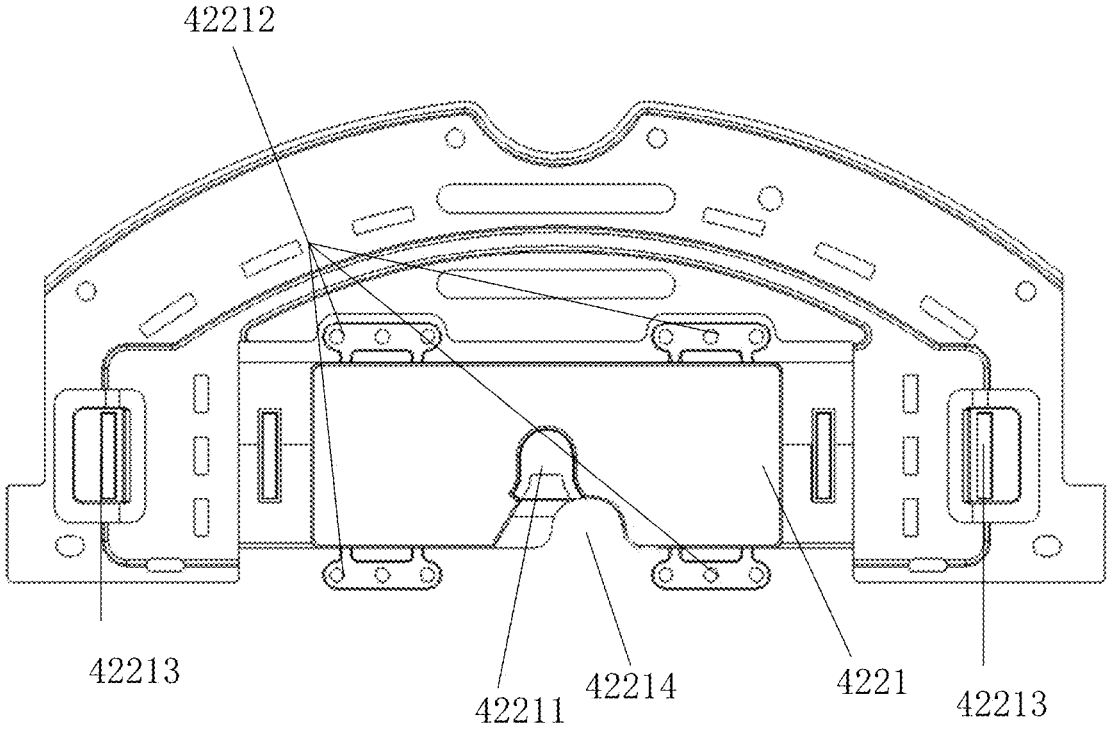
FIG. 16 is a schematic diagram of an assembly structure of a cleaning substrate according to an embodiment of the present disclosure.

As an optional embodiment of the present disclosure, the supporting platform 422 includes a cleaning substrate 4221 movably disposed on the supporting platform 422 and substantially reciprocating under the vibration of the vibrating member 4213. In some examples, as shown in FIG. 16, the cleaning substrate 4221 includes an assembly notch 42211 disposed at a position in contact with the vibrating member 4213. When the supporting platform 422 is connected to the driving platform 421, the vibrating member 4213 is assembled to the assembly notch 42211, so that the cleaning substrate 4221 may substantially reciprocate synchronously with the vibrating member 4213. The cleaning substrate 4221 includes four first limiting positions 42212 in the travelling direction of the cleaning device, and the four first limiting positions 42212 are flexibly connected to the cleaning substrate 4221 with a small elastic scaling space, thereby limiting the movement of the cleaning substrate 4221 relative to the supporting platform 422 in the travelling direction of the cleaning device. The cleaning substrate 4221 includes two second limiting portions 42213 in a direction perpendicular to the travelling direction of the cleaning device, and the two second limiting positions 42213 limit a range of the reciprocating motion of the cleaning substrate 4221 in the direction perpendicular to the travelling direction of the cleaning device. Furthermore, a water discharging hole 42214 is provided near the assembly notch 42211 of the cleaning substrate 4221 to make water from the water discharging device 4217 flow to the cleaning head 410 via the water discharging hole. The cleaning substrate 4221 substantially reciprocates due to the influence of the limiting positions and the vibration buffering device. The cleaning substrate 4221 is located in a portion of the supporting platform 422, and the vibration frequency may be made higher by means of local vibration, such as reaching a frequency range of the sound wave. The movable components and the fixed components of the driving platform 421 are restricted from moving in the travelling direction of the automatic cleaning device through connections with less elasticity, and are connected flexibly and allowed to move in the direction substantially perpendicular to the travelling direction, that is, in the vibration direction of the vibrating member 4213.

Figure 12:
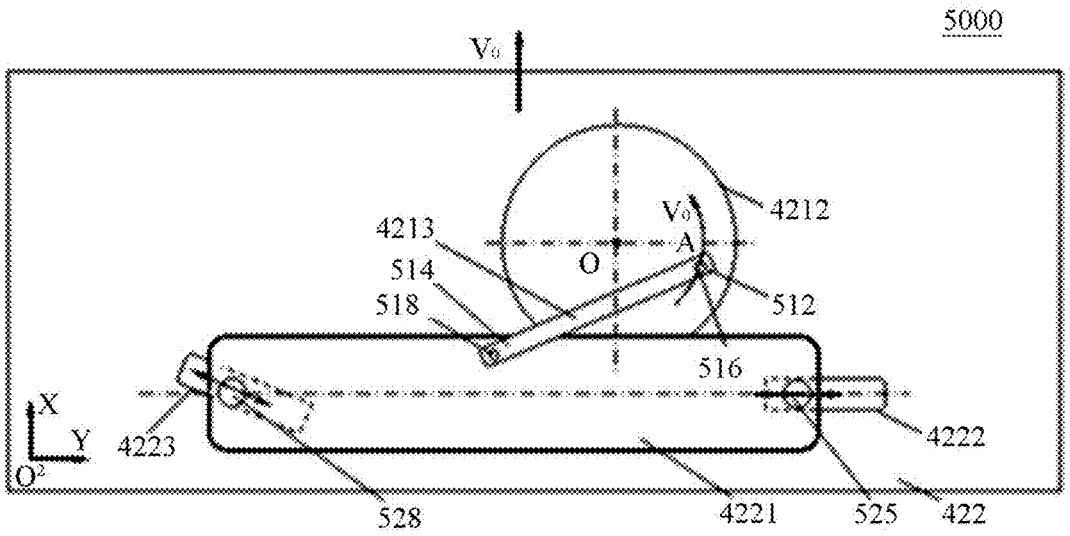
FIG. 12 is a schematic diagram of a cleaning head driving mechanism based on a crank slider mechanism according to another embodiment of the present disclosure.

FIG. 12 shows another cleaning head driving mechanism 5000 based on a crank slider mechanism according to a plurality of embodiments of the present disclosure. The driving mechanism 5000 may be applied to the driving platform 421. The driving mechanism 5000 includes a driving wheel 4212, a vibrating member 4213, a cleaning substrate 4221, a sliding slot 4222 (a first sliding slot) and a sliding slot 4223 (a second sliding slot).

The sliding slots 4222 and 4223 are formed in the supporting platform 422. Both ends of the cleaning substrate 4221 include a slider 525 (a first slider) and a slider 528 (a second slider), respectively. The sliders 525 and 528 are protrusions on both ends of the cleaning substrate 4221 respectively. The slider 525 is inserted into the sliding slot 4222 and may slide along the sliding slot 4222, and the slider 528 is inserted into the sliding slot 4223 and may slide along the sliding slot 4223. In some embodiments, the sliding slot 4222 and the sliding slot 4223 are on the same line. In some embodiments, the sliding slot 4222 and the sliding slot 4223 are not on the same line. In some embodiments, the sliding slot 4222 and the sliding slot 4223 extend along the same direction. In some embodiments, extending directions of the sliding slot 4222 and the sliding slot 4223 are the same as that of the cleaning substrate 4221. In some embodiments, extending directions of the sliding slot 4222 and the sliding slot 4223 are different from that of the cleaning substrate 4221. In some embodiments, the extending direction of the sliding slot 4222 is different from that of the sliding slot 4223. For example, as shown in FIG. 12, the extending direction of the sliding slot 4222 is the same as that of the cleaning substrate 4221, and the extending direction of the sliding slot 4223 is at a certain angle with that of the sliding slot 4222.

The vibrating member 4213 includes a swiveling end 512 and a sliding end 514. The swiveling end 512 is connected to the driving wheel 4212 through a first pivot 516, and the sliding end 514 is connected to the cleaning substrate 4221 through a second pivot 518.

A swiveling center of the driving wheel 4212 is a point O, and a pivoting center of the first pivot 516 is a point A. The point O and the point A do not coincide, and the distance between the point O and the point A is a preset distance d.

When the driving wheel 4212 rotates, the point A also swivels along a circular path. Correspondingly, the swiveling end 512 follows the point A to swivel along the circular path, and the sliding end 514 drives the cleaning substrate 4221 to slide through the second pivot 518. Correspondingly, the slider 525 of the cleaning substrate 4221 linearly reciprocates along the sliding slot 4222, and the slider 528 linearly reciprocates along the sliding slot 4223. In FIG. 4, a moving speed of the mobile platform 100 is V0, and a moving direction thereof is a target direction. According to some embodiments, when the sliding slot 4223 and the sliding slot 4222 are approximately perpendicular to the direction of the moving speed V0 of the mobile platform 100 respectively, an overall displacement of the cleaning substrate 4221 is substantially perpendicular to the target direction. According to some other embodiments, when any one of the sliding slot 4223 and the sliding slot 4222 forms an angle other than 90 degrees with the target direction, the overall displacement of the cleaning substrate 4221 includes both a component perpendicular to the target direction and a component parallel to the target direction.

Further, a vibration buffering device 4215 is included, which is disposed on the connecting rod 4214 for reducing vibration in a specific direction. In this embodiment, the vibration buffering device 4215 is configured to reduce the vibration in a direction of a movement component perpendicular to the target direction of the automatic cleaning device.

Figure 13:
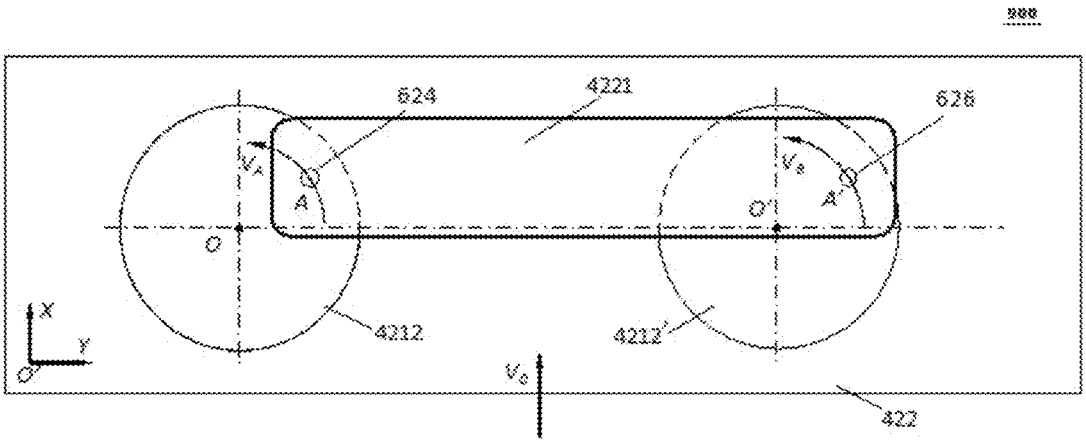
FIG. 13 is a schematic diagram of a cleaning head driving mechanism based on a double-crank mechanism according to another embodiment of the present disclosure.

FIG. 13 shows another cleaning head driving mechanism 900 based on a double-crank mechanism according to a plurality of embodiments of the present disclosure. The driving mechanism 900 may be applied to the driving platform 421. The driving mechanism 900 includes a driving wheel 4212 (a first driving wheel), a driving wheel 4212' (a second driving wheel) and a cleaning substrate 4221.

The cleaning substrate 4221 has two ends, a first end thereof is connected to the driving wheel 4212 through a pivot 624 (a first pivot), and a second end thereof is connected to the driving wheel 4212' through a pivot 626 (a second pivot). A swiveling center of the driving wheel 4212 is a point O, and a pivoting center of the pivot 624 is a point A. The point O and the point A do not coincide, and the distance between the point O and the point A is a preset distance d. A swiveling center of the driving wheel 236 is a point O', and a pivoting center of the pivot 626 is point A'. The point O' and the point A' do not coincide, and the distance between the point O' and the point A' is a preset distance d. In some embodiments, the point A, the point A', the point O, and the point O' are located on the same plane. Therefore, the driving wheel 4212, the driving wheel 4212' and the cleaning substrate 4221 may form a double-crank mechanism (or a parallelogram mechanism), wherein the cleaning substrate 4221 acts as a coupling lever, and the driving wheels 4212 and 4212' act as two cranks.

Further, a vibration buffering device 4215 is included, which is disposed on the connecting rod 4214 for reducing vibration in a specific direction. In this embodiment, the vibration buffering device 4215 is configured to reduce the vibration in a direction of a movement component perpendicular to the target direction of the automatic cleaning device.

Figure 14:
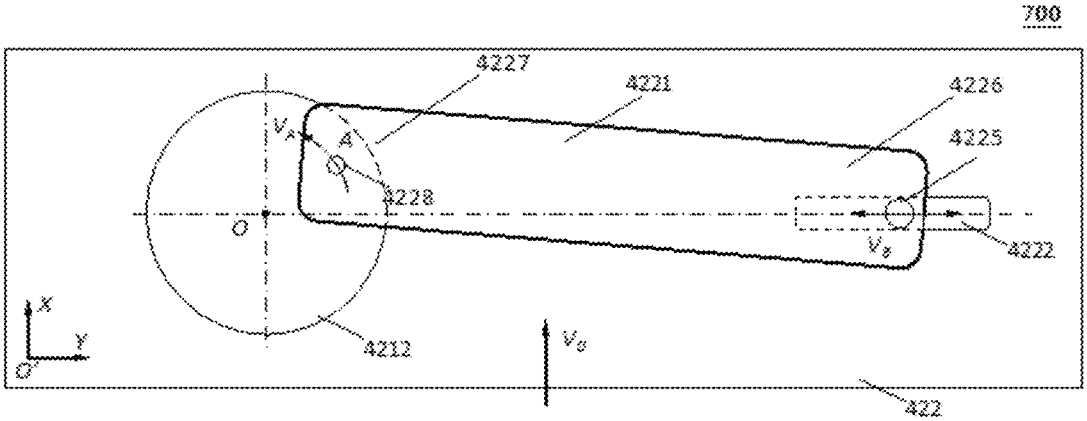
FIG. 14 is a schematic diagram of a cleaning head driving mechanism based on a crank mechanism according to another embodiment of the present disclosure.

FIG. 14 shows a driving mechanism 700 based on a crank slider mechanism according to a plurality of embodiments of the present disclosure. The driving mechanism 700 may be applied to the driving platform 421. The driving mechanism 700 includes a driving wheel 4212, a cleaning substrate 4221 and a sliding slot 4222.

The sliding slot 4222 is formed in the supporting platform 422. The cleaning substrate 4221 includes a swiveling end 4227 and a sliding end 4226. The swiveling end 4227 is connected to the driving wheel 4212 through a pivot 4228. A swiveling center of the driving wheel 4212 is a point O. and a pivoting center of the pivot 4228 of the swiveling end is a point A. The point O and the point A do not coincide, and the distance between the point O and the point A is a preset distance d. The sliding end 4226 includes a slider 4225. The slider 4225 is a protrusion on the sliding end 4226. The slider 4225 is inserted into the sliding slot 4222 and may slide along the sliding slot 4222. Therefore, the driving wheel 4212, the cleaning substrate 4221, the slider 4225 and the sliding slot 4222 constitute the crank slider mechanism.

When the driving wheel 4212 rotates, the point A swivels along a circular path. Correspondingly, the swiveling end 4227 of the cleaning substrate 4221 follows the point A to swivel along the circular path, and the slider 4225 also slides in the sliding slot 4222 and reciprocates linearly. As a result, the cleaning substrate 4221 starts to reciprocate. According to some embodiments, the sliding slot 4222 is approximately perpendicular to a direction of the target direction of the moving speed of the mobile platform. Therefore, the linear motion of the sliding end 4226 includes a component perpendicular to the target direction, and the circular swiveling motion of the swiveling end 4227 includes both a component perpendicular to the target direction and a component parallel to the target direction.

In FIG. 14, a moving speed of the mobile platform is V0, and a moving direction thereof is a target direction, and the sliding slot 4222 is approximately perpendicular to the target direction. At this time, the reciprocating motion of the cleaning substrate 4221 as a whole includes both a movement component parallel to the target direction of the automatic cleaning device and a movement component perpendicular to the target direction of the automatic cleaning device.

Further, the supporting platform 422 further includes an elastic detaching button 4229 disposed on at least one side of the supporting platform 422 for detachably connecting the supporting platform 422 to pawls 4216 of the driving platform 421, so that the supporting platform 422 is detachably and mechanically fixed on the driving platform 421, and fixed relative to the driving platform and the automatic cleaning device. At least one assembly region 4224 is disposed on the supporting platform 422 for assembling the cleaning head 410. The assembly region 4224 may be formed of an adhesive material with an adhesive layer.

As an optional embodiment of the present disclosure, as shown in FIG. 9, the cleaning head 410 includes a movable region 412 connected to the cleaning substrate 4221 to substantially reciprocate along the surface to be cleaned under the driving of the cleaning substrate 4221. The movable region 412 is disposed at a substantially central position of the cleaning head 410.

In some examples, an adhesive layer is provided on a side of the movable region 412 connected to the cleaning substrate 4221, and the movable region 412 is connected to the cleaning substrate 4221 through the adhesive layer.

In some examples, the cleaning head 410 further includes a fixed region 411 connected to a bottom of the supporting platform 422 through the at least one assembly region 4224. The fixed region 411 cleans at least a part of the operating surface along with the movement of the supporting platform 422.

Further, the cleaning head 410 further includes a flexible connecting portion 413 disposed between the fixed region 411 and the movable region 412 for connecting the fixed region 411 and the movable region 412. The cleaning head 410 further includes a sliding fastener 414 extending along an edge of the cleaning head 410 and detachably mounted at an engagement position 4225 of the supporting platform 422.

In this embodiment, as shown in FIG. 9, the cleaning head 410 may be made from a certain elastic material, and the cleaning head 410 is secured to the surface of the supporting platform 422 by the bonding layer, so as to achieve reciprocal motion. When the cleaning head 410 works, the cleaning head 410 is always in contact with the surface to be cleaned.

The water delivery mechanism includes a water discharging device 4217 that may be directly or indirectly connected to a cleaning liquid outlet of a water tank (not shown), that is, a liquid outlet of the clean water tank. The cleaning liquid may flow to the water discharging device 4217 via the cleaning liquid outlet of the water tank, and may be evenly coated on the surface to be cleaned through the water discharging device. A connecting member (not shown) may be provided on the water discharging device, and the water discharging device is connected to the cleaning liquid outlet of the water tank through the connecting member. The water discharging device is provided with a distribution port which may be a continuous opening or a combination of several discontinuous small openings, and several nozzles may be provided at the distribution port. The cleaning liquid flows to the distribution port via the cleaning liquid outlet of the water tank and the connecting member of the water discharging device, and is evenly coated on the operating surface via the distribution port.

The water delivery mechanism may further include a clean water pump 4219 and/or a clean water pump pipe 4218. The clean water pump 4219 may be connected with the cleaning liquid outlet of the water tank directly, or connected with the cleaning liquid outlet of the water tank through the clean water pump pipe 4218.

The clean water pump 4219 may be connected to the connecting member of the water discharging device, and configured to pump the cleaning liquid from the water tank to the water discharging device. The clean water pump may be a gear pump, a vane pump, a plunger pump, a peristaltic pump, or the like.

The water delivery mechanism draws the cleaning liquid out of the clean water tank through the clean water pump 4219 and the clean water pump pipe 4218, and transports the cleaning liquid to the water discharging device. The water discharging device 4217 may be a sprinkler head, a drip hole, a wet cloth, or the like, and may uniformly spread water on the cleaning head so as to wet the cleaning head and the surface to be cleaned. Stains on the wetted surface to be cleaned can be cleaned more easily. In the wet cleaning assembly 400, the power/flow rate of the clean water pump may be adjusted.

Figure 17:
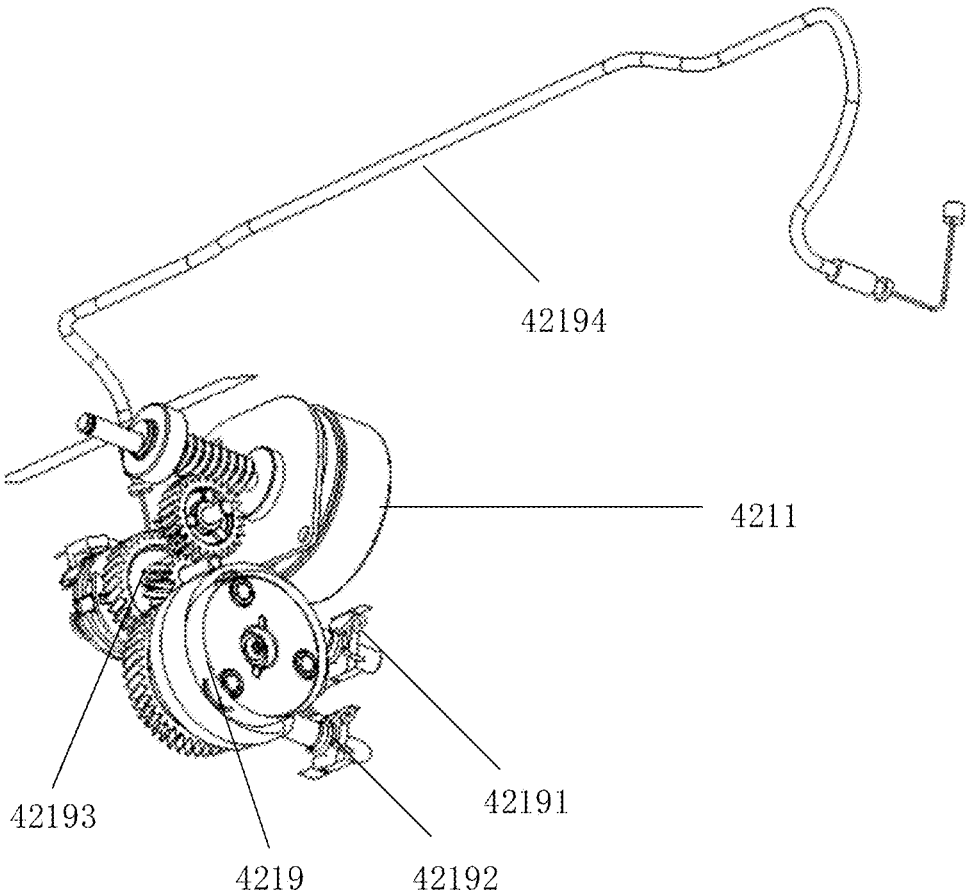
FIG. 17 is a structural diagram of a motor-driven clean water pump according to an embodiment of the present disclosure.

Further, as shown in FIG. 17, the motor 4211 drives the clean water pump 4219 to wriggle through a gear set 42193. Through the wriggle of the clean water pump 4219, the clean water enters from a water inlet 42191, flows out of a water outlet 42192, and is then transported to the water discharging device 4217 through the clean water pump pipe 4218. The water flowing out of the water discharging device 4217 flows to the cleaning head 410 via the water discharging hole.

Figure 18:
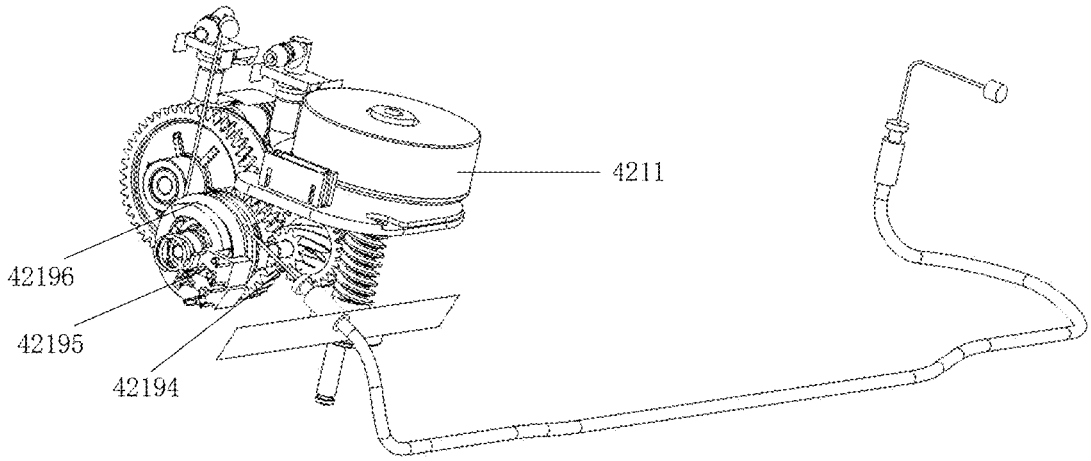
FIG. 18 is a structural diagram of a motor-driving lifting module according to an embodiment of the present disclosure.

Further, as shown in FIG. 18, the motor 4211 drives a cable gear 42196 to rotate through the gear set 42193. A cable 42194 is wound on the cable gear 42196, and is wound and suspended on the driving platform 421, and the cable gear 42196 pulls the cable 42194 to rise and drop so as to lift and lower the driving platform 421. The cable gear 42196 and the cable 42194 are core components of the lifting module.

A clutch 42195 is disposed on the gear set 42193 and the cable gear 42196. By controlling the engagement and disengagement of the clutch 42195, the motor 4211 controls three motion modules. The motor 4211 rotates in one direction to drive the vibrating member to vibrate and enable the clean water pump 4219 to supply water simultaneously; and rotates in an opposite direction to drive the lifting module to lift and lower through the cable 42194. In some examples, the combined design of the gear set achieves the control of the three motion modules in different combinations, for example, rotating the clean water pump in one direction to supply water, and rotating in the opposite direction to control the lifting and lowering and vibration. In some examples, two motors may also be used to control the three motion modules, but an extra motor also increases the cost.

Since the cleaning module of the automatic cleaning device is provided with the dry-cleaning module and the wet-cleaning module, a more comprehensive cleaning function may be provided. Meanwhile, by adding the driving unit and the vibration region to the wet-cleaning module, the cleaning head may reciprocate to repeatedly clean the surface to be cleaned. Therefore, in a movement trajectory of a cleaning robot, a region may be cleaned several times by the cleaning robot passing the region just one time, thereby greatly enhancing the cleaning effect. The cleaning effect is obvious especially for a region with more stains.

Figure 19:
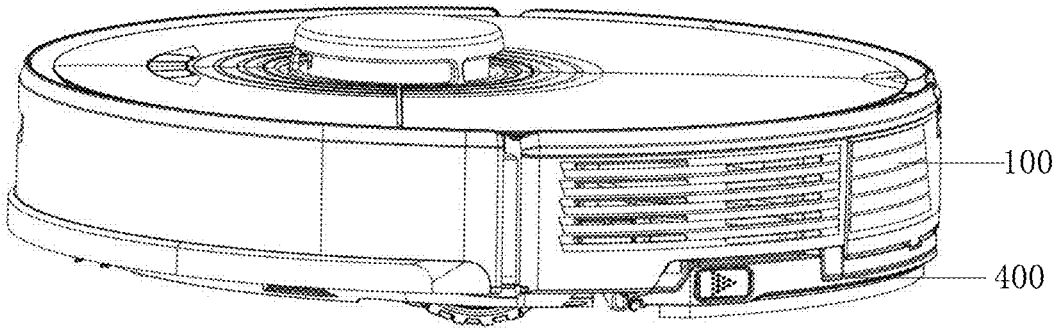
FIG. 19 is a schematic diagram of an automatic cleaning device in a lifting state according to an embodiment of the present disclosure.
Figure 20:
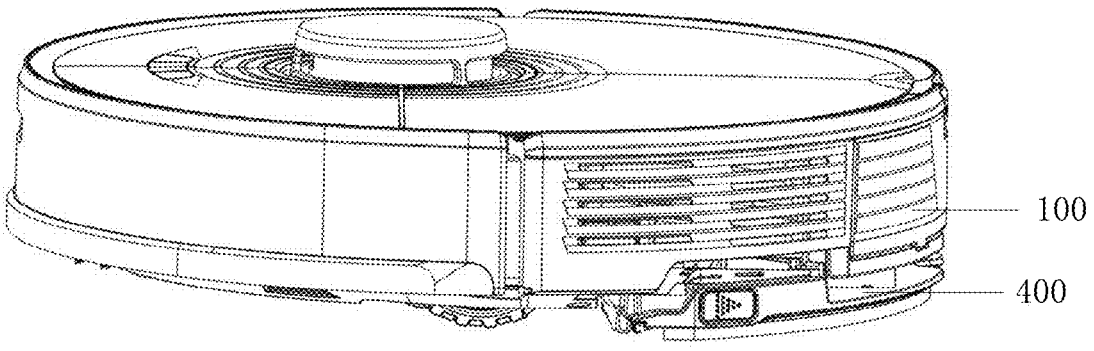
FIG. 20 is a schematic diagram of an automatic cleaning device in a lowering state according to an embodiment of the present disclosure.

As shown in FIG. 19 and FIG. 20, the wet-cleaning module 400 is movably connected to the mobile platform 100 through a four-link lifting structure 500, and configured to clean at least a part of the operating surface by means of wet cleaning. The four-link lifting structure 500 is a parallelogram structure for switching the wet-cleaning module 400 between a lifting state and a lowering state. In the lifting state, the wet-cleaning module 400 leaves the operating surface, as shown in FIG. 19; and in the lowering state, the wet-cleaning module 400 is attached to the operating surface, as shown in FIG. 20.

Figure 21:
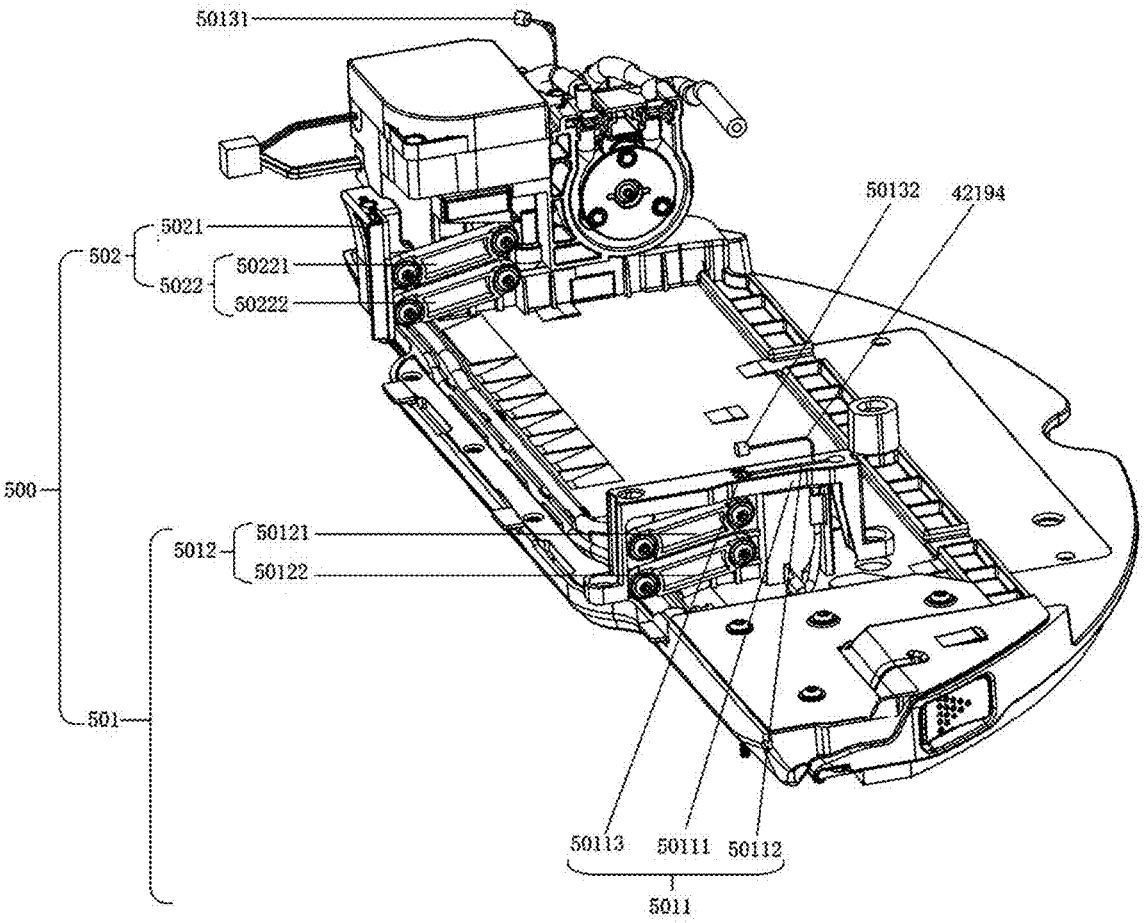
FIG. 21 is a schematic diagram of a four-link lifting structure in a lifting state according to an embodiment of the present disclosure.
Figure 22:
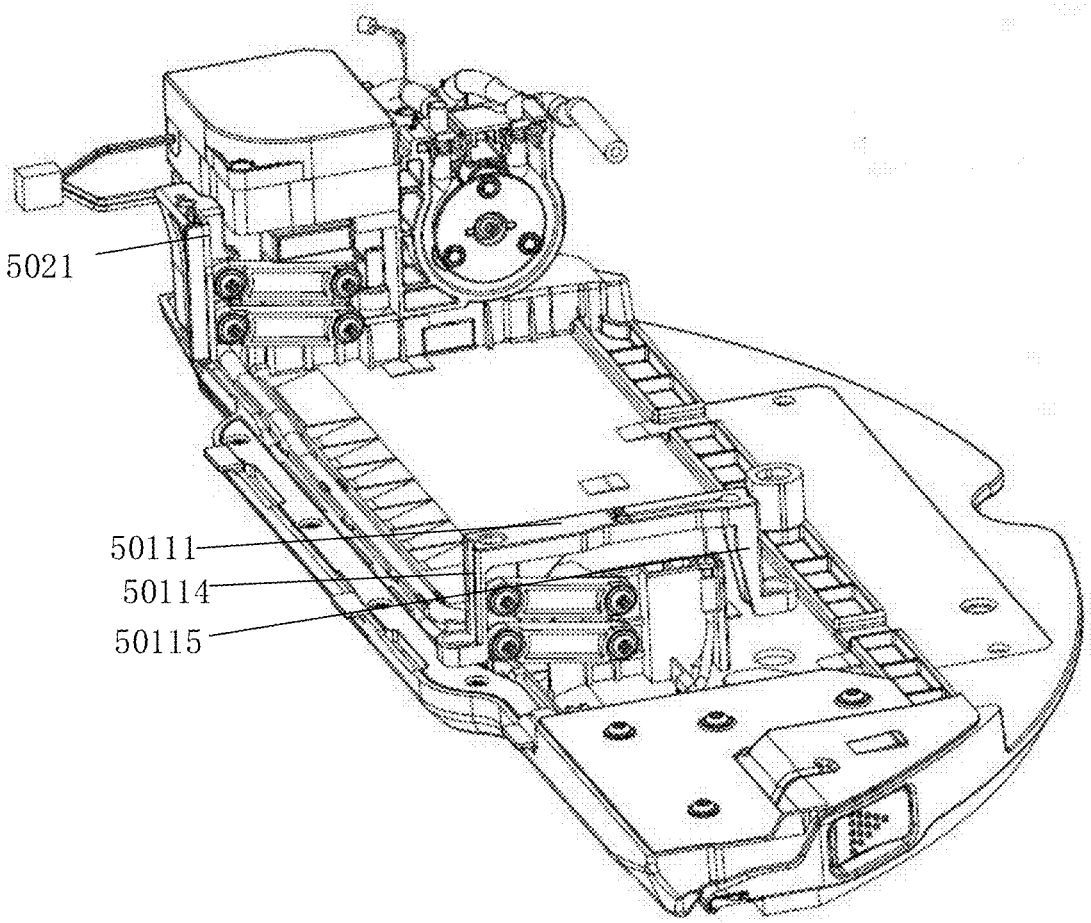
FIG. 22 is a schematic diagram of a four-link lifting structure in a lowering state according to an embodiment of the present disclosure.

As shown in FIG. 21 and FIG. 22, the four-link lifting structure 500 includes a first connecting end 501 for providing active power to switch the wet-cleaning module 400 between the lifting state and the lowering state; and a second connecting end 502 disposed opposite to the first connecting end 501 and rotating under the action of the active power. The first connecting end 501 and the second connecting end 502 are located on both sides of the wet-cleaning module 400 respectively to lift or lower the wet-cleaning module 400 by stably providing a lifting or lowering force.

Specifically, the first connecting end 501 includes a first bracket 5011 fixedly connected to the bottom of the mobile platform 100. The first bracket 5011 is roughly shaped like a Chinese character "凡", and includes a cross beam 50111, a first longitudinal beam 50114 and a second longitudinal beam 50115. A tail end of each of the first longitudinal beam 50114 and the second longitudinal beam 50115 is fixedly connected to the mobile platform 100 through a bolt to provide a supporting force when the wet-cleaning module 400 is lifted and lowered.

The first connecting end 501 further includes a first connecting rod pair 5012, one end of the first connecting rod pair 5012 is rotatably connected to the first bracket 5011, and the other end of the first connecting rod pair 5012 is rotatably connected to the wet-cleaning module 400. The first connecting rod pair 5012 may be of a hollow structure, which can reduce an overall weight of lifting and lowering ends.

In some examples, the first connecting rod pair 5012 includes a first connecting rod 50121 and a second connecting rod 50122 which are arranged in parallel. A first end of each of the first connecting rod 50121 and the second connecting rod 50122 is rotatably connected to the first longitudinal beam 50114 through a movable stud, and a second end of each of the first connecting rod 50121 and the second connecting rod 50122 is rotatably connected to the wet-cleaning module 400 through a movable stud. For example, both ends of each of the first connecting rod 50121 and the second connecting rod 50122 are provided with a through hole having a diameter greater than that of the movable stud, respectively, so that the movable stud may rotate freely within the through hole, and is fixedly connected to the first longitudinal beam 50114 after passing through the through hole. When the motor 4211 provides a pulling force to the first ends through the cable, the first ends of the first connecting rod 50121 and the second connecting rod 50122 simultaneously rotate around the movable studs at the first ends, and the second ends thereof are lifted under the pulling force of the cable, so that the wet-cleaning module 400 is lifted. When the motor 4211 releases the pulling force to the first ends through the cable, the first ends of the first connecting rod 50121 and the second connecting rod 50122 simultaneously rotate reversely around the movable studs at the first ends, and the second ends thereof are lowered under the action of gravity, so that the wet-cleaning module 400 is lowered.

The lifting structure 500 further includes a cable 42194 for providing a pulling force to rotate the first connecting rod pair 5012 within a preset angle. The cable 42194 includes a cable motor terminal 50131 connected to the driving unit 420, for example, wound on the gear connected to the motor output shaft to extend and retract under the rotation of the motor; and a cable bracket terminal 50132 connected to the first bracket 5011. The motor lifts or lowers the second ends of the first connecting rod 50121 and the second connecting rod 50122 through the cable 42194.

In some examples, the first bracket 5011 further includes a sliding slot 50112 extending along a surface of the cross beam 50111; and a snapping hole 50113 running through the cross beam 50111 and disposed at an extension end of the sliding slot 50112 for accommodating and snapping the cable bracket terminal 50132. The cable 42194 is connected to the first ends of the first connecting rod 50121 and the second connecting rod 50122 through the sliding slot 50112 and the snapping hole 50113. The sliding slot 50112 can restrict a moving direction of the cable to ensure the stability of lifting and lowering of the module, and the width of the sliding slot should match the thickness of the cable.

As shown in FIG. 21, the second connecting end 502 includes a second bracket 5021 fixedly connected to the bottom of the mobile platform 100; and a second connecting rod pair 5022, one end of the second connecting rod pair 5022 is rotatably connected to the second bracket 5021, and the other end of the second connecting rod pair 5022 is rotatably connected to the wet-cleaning module 400. The second connecting rod pair 5022 rotates along with the rotation of the first connecting rod pair 5012. The second connecting rod pair 5022 may be of a hollow structure, which can reduce the overall weight of lifting and lowering ends.

Specifically, the second connecting rod pair 5022 includes a third connecting rod 50221 and a fourth connecting rod 50222 which are arranged in parallel. A first end of each of the third connecting rod 50221 and the fourth connecting rod 50222 is rotatably connected to the second bracket 5021 through a movable stud, and a second end of each of the third connecting rod 50221 and the fourth connecting rod 50222 is rotatably connected to the wet-cleaning module 400 through a movable stud. For example, both ends of each of the third connecting rod 50221 and the fourth connecting rod 50222 are provided with a through hole having a diameter greater than that of the movable stud, respectively, so that the movable stud may rotate freely within the through hole, and is fixedly connected to the second bracket 5021 and the wet-cleaning module 400 after passing through the through hole. When the first connecting end 501 rotates under the driving of the motor 4211, the first ends of the third connecting rod 50221 and the fourth connecting rod 50222 simultaneously rotate around the movable studs at the first ends, and the second ends of the third connecting rod 50221 and the fourth connecting rod 50222 simultaneously rotate around the movable studs at the second ends, so that the wet-cleaning module 400 is lifted. When the pulling force to the first connecting end 501 is released, the third connecting rod 50221 and the fourth connecting rod 50222 simultaneously rotate reversely around the movable studs and are lowered under the action of gravity, so that the wet-cleaning module 400 is lowered.

Through the four-link lifting structure disposed between the wet-cleaning module and the mobile platform, the wet-cleaning module may be lifted and lowered relative to the mobile platform. When a mopping task is performed, the wet-cleaning module is lowered to enable the wet-cleaning module to be in contact with the floor; and when the mopping task is completed, the wet-cleaning module is lifted to separate the wet-cleaning module from the floor, thereby avoiding the increased resistance due to the existence of the cleaning module when the cleaning device moves freely on the cleaned surface.

In cooperation with a surface medium sensor and other sensors that can detect a surface type of the surface to be cleaned, the lifting module enables the wet-cleaning module to perform a cleaning operation according to different surfaces to be cleaned. For example, the lifting module lifts the wet-cleaning module in case of a carpet surface, and lowers the wet-cleaning module in case of a floor surface, a floor tile surface or the like, for cleaning. Thus, a more comprehensive cleaning effect is achieved.

Figure 23:
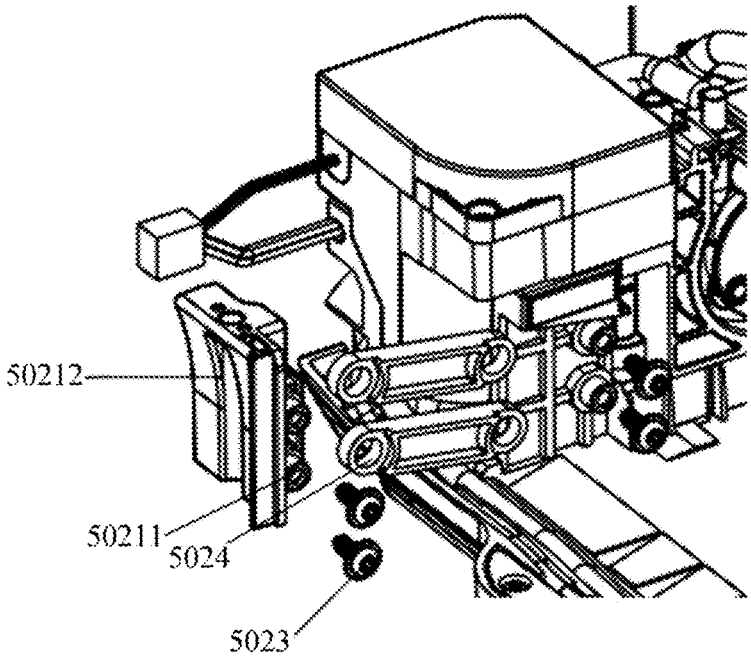
FIG. 23 is a schematic diagram of a four-link lifting structure in an enlarged state according to an embodiment of the present disclosure.

As shown in FIG. 23, which is a diagram of the dry-cleaning module 151 in a lifting state. A floating lifting structure 600 is connected to the dry-cleaning module 151 and configured to enable the dry-cleaning module 151 to passively move vertically relative to the mobile platform 100. Specifically, the floating lifting structure 600 is a parallelogram four-link lifting structure configured to passively switch the dry-cleaning module 151 between a lifting state and a lowering state under the action of an external force.

In some examples, the floating lifting structure 600 includes a first fixed bracket 601 fixedly connected to the mobile platform 100; a second fixed bracket 602 fixedly connected to the dry-cleaning module 151; and a connecting rod pair 603, one end of the connecting rod pair 603 is rotatably connected to the first fixed bracket 601 through a movable stud, and the other end of the connecting rod pair 603 is rotatably connected to the second fixed bracket 602 through a movable stud. The first fixed bracket 601 and the second fixed bracket 602 are connected through a flexible connecting member. When encountering an obstacle, the dry-cleaning module 151 is pushed upward, and the first fixed bracket 601 rotates around the connecting rod pair 603 and then retracted upward relative to the second fixed bracket 602, so as to achieve passive lifting. After passing the obstacle, the dry-cleaning module 151 falls under the action of gravity and comes into contact with the operating surface, and the cleaning device continues to move forward for the cleaning task. With the parallelogram four-link lifting structure, the cleaning device can pass the obstacle more flexibly, and is less liable to damage.

In some examples, the connecting rod pair 603 includes a first connecting rod pair 6031, one end of the first connecting rod pair 6031 is rotatably connected to a first end of the first fixed bracket 601 through a movable stud, and the other end of the first connecting rod pair 6031 is rotatably connected to a first end of the second fixed bracket 602 through a movable stud; and a second connecting rod pair 6032 disposed opposite to the first connecting rod pair 6031, one end of the second connecting rod pair 6032 is rotatably connected to a second end of the first fixed bracket 601 through a movable stud, and the other end of the second connecting rod pair 6032 is rotatably connected to a second end of the second fixed bracket 602 through a movable stud. The first connecting rod pair 6031 or the second connecting rod pair 6032 may be of a hollow structure, which can reduce the overall weight of lifting and lowering ends.

In some examples, the first connecting rod pair 6031 includes a first connecting rod 60311 and a second connecting rod 60312 which are arranged in parallel. One end of each of the first connecting rod 60311 and the second connecting rod 60312 is provided with a first shaft hole, and the other end thereof is provided with a second shaft hole. The first connecting rod 60311 and the second connecting rod 60312 are rotatably fixed to the first end of the first fixed bracket 601 by the movable studs passing through the first shaft holes, and the first connecting rod 60311 and the second connecting rod 60312 are rotatably fixed to the first end of the second fixed bracket 602 by the movable studs passing through the second shaft holes. For example, both ends of each of the first connecting rod 60311 and the second connecting rod 60312 are provided with clamping holes (not shown), each having a diameter greater than that of the movable stud, respectively, so that the movable stud can rotate freely within the clamping hole, and the movable stub is fixedly connected to the first fixed bracket 601 after passing through the clamping holes. When encountering a raised obstacle, the dry-cleaning module 151 is pushed upward under the action of the obstacle, the first ends of the first connecting rod 60311 and the second connecting rod 60312 simultaneously rotate around the movable studs at the first ends, and the second ends of the first connecting rod 60311 and the second connecting rod 60312 simultaneously rotate around the movable studs at the second ends, so that the dry-cleaning module 151 is lifted. When passing the obstacle, the dry-cleaning module 151 falls under the action of gravity and comes into contact with the operating surface.

Figure 24:
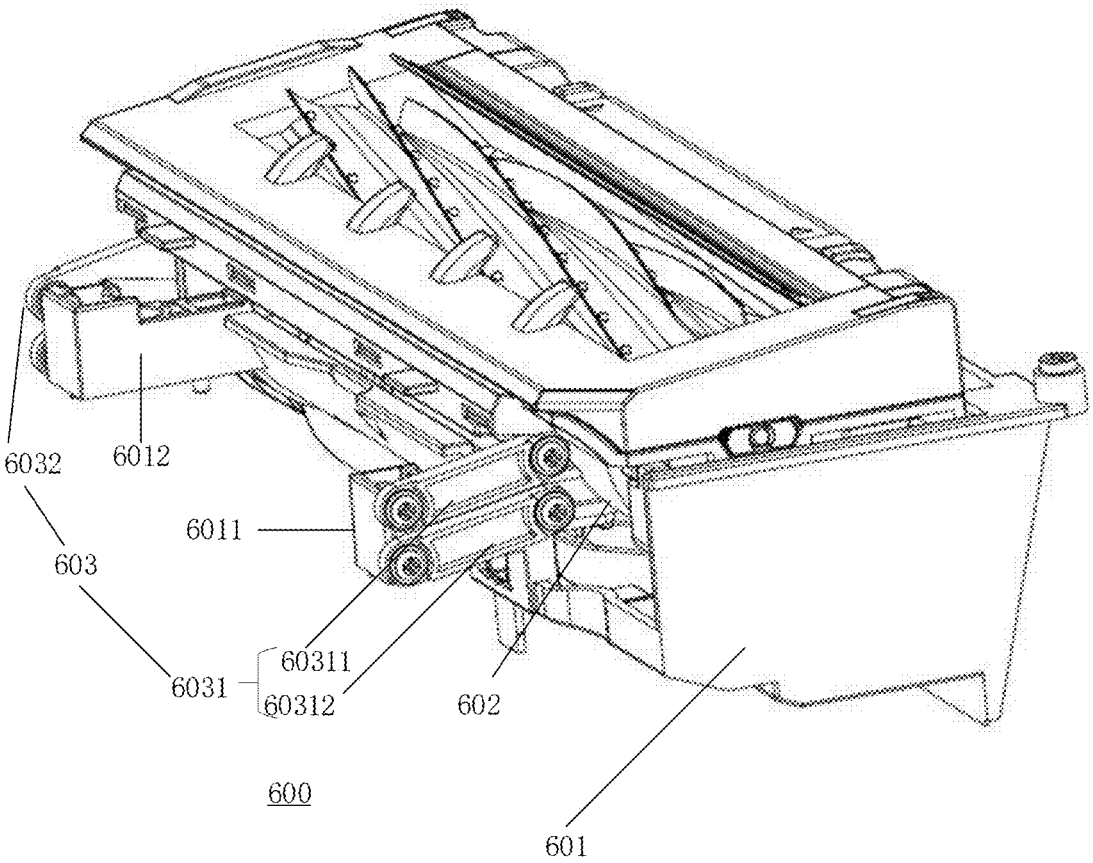
FIG. 24 is a schematic structural diagram of a dry-cleaning module in a lowering state according to an embodiment of the present disclosure.
Figure 25:
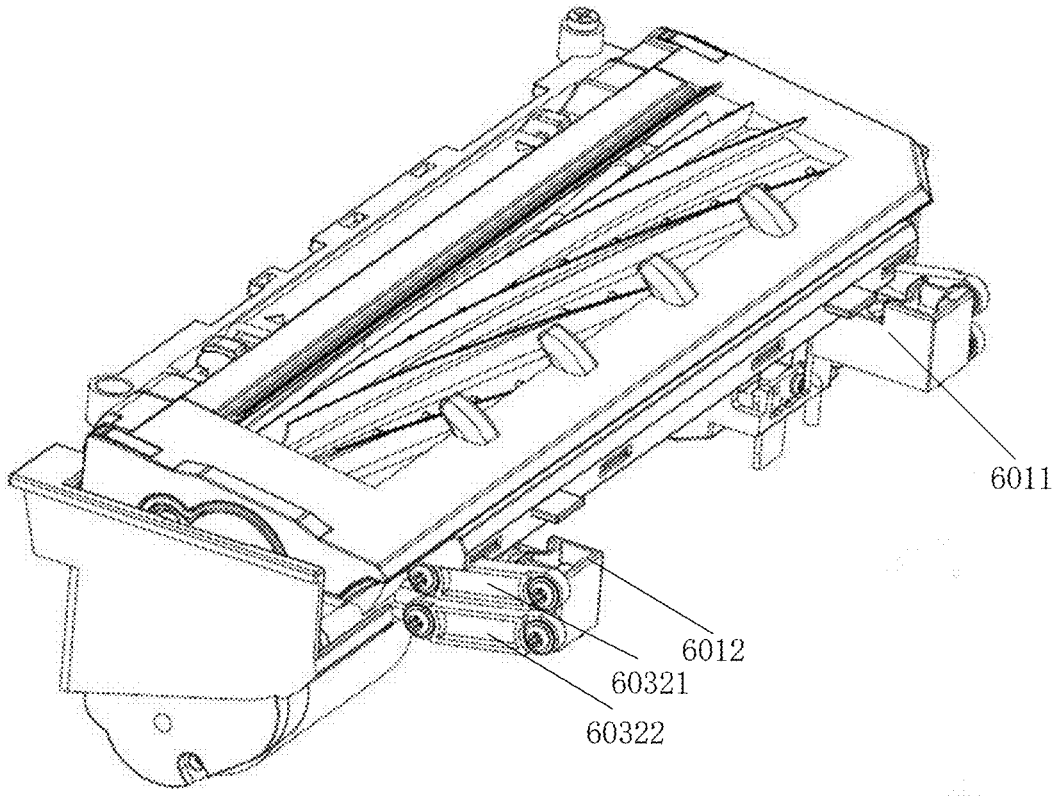
FIG. 25 is a schematic structural diagram of a dry cleaning substrate in a lifting state according to an embodiment of the present disclosure.

In some examples, as shown in FIG. 24 and FIG. 25, which are diagrams of the dry-cleaning module 151 in a lifting state, the second connecting rod pair 6032 includes a third connecting rod 60321 and a fourth connecting rod 60322 which are arranged in parallel. One end of each of the third connecting rod 60321 and the fourth connecting rod 60322 is provided with a third shaft hole, and the other end thereof is provided with a fourth shaft hole. The third connecting rod 60321 and the fourth connecting rod 60322 are rotatably fixed to the second end of the first fixed bracket 601 by the movable studs passing through the third shaft holes, and the third connecting rod 60321 and the fourth connecting rod 60322 are rotatably fixed to the second end of the second fixed bracket 602 by the movable studs passing through the fourth shaft holes. For example, both ends of each of the third connecting rod 60321 and the fourth connecting rod 60322 are provided with clamping holes (not shown) each having a diameter greater than that of the movable stud, respectively, so that the movable stud can rotate freely within the clamping hole, and the movable stub is fixedly connected to the first fixed bracket 601 after passing through the clamping holes. When encountering a raised obstacle, the dry-cleaning module 151 is pushed upward under the action of the obstacle, the first ends of the third connecting rod 60321 and the fourth connecting rod 60322 simultaneously rotate around the movable studs at the first ends, and the second ends of the third connecting rod 60321 and the fourth connecting rod 60322 simultaneously rotate around the movable studs at the second ends, so that the dry-cleaning module 151 is lifted. When passing the obstacle, the dry-cleaning module 151 falls under the action of gravity and comes into contact with the operating surface.

As an optional embodiment, the first fixed bracket 601 includes a first fixed portion 6011 protruding from the first fixed bracket 601 and extending laterally outward for carrying the first connecting rod pair 6031; and a second fixed portion 6012 disposed symmetrically with the first fixed portion 6011 for carrying the second connecting rod pair 6032. The first fixed portion 6011 and the second fixed portion 6012 are configured to support the connecting rod pairs in a protruding manner, so that the connecting rod pairs may rotate freely to ensure the free lifting and lowering of the dry-cleaning module 151.

In some examples, the floating lifting structure 600 further includes a flexible connecting member (not shown) connected between the first fixed bracket 601 and the second fixed bracket 602. When the operating surface is uneven, the second fixed bracket 602 moves vertically relative to the first fixed bracket 601 through the flexible connecting member.

In the dry-cleaning module, the four-link floating lifting structure is disposed to enable the dry-cleaning module to passively move vertically relative to the mobile platform. When encountering an obstacle during operation, the cleaning device can easily pass the obstacle through the four-link floating lifting structure, thereby avoiding the damage to the cleaning device by the obstacle.

According to a specific embodiment of the present disclosure, as shown in FIG. 9 as well as FIGS. 1 and 2, the present disclosure provides an automatic cleaning device. The same structure in this embodiment and the foregoing embodiment achieve the same function or effect as that of the foregoing embodiment, which is not repeated herein. Specifically, the automatic cleaning device includes a mobile platform 100 configured to move automatically on an operating surface, and a cleaning module 150 arranged on the mobile platform 100. The cleaning module includes a dry-cleaning module 151 configured to clean at least a part of the operating surface by means of dry cleaning; and a wet-cleaning module 400 configured to clean at least a part of the operating surface by means of wet cleaning. The wet-cleaning module 400 includes a cleaning head 410 configured to clean the operating surface, and a driving unit 420 configured to drive the cleaning head 410 to substantially reciprocate along a target surface, the target surface being a part of the operating surface. The driving unit 420 includes a driving platform 421 and a supporting platform 422 detachably connected to the driving platform 421.

Figure 26:
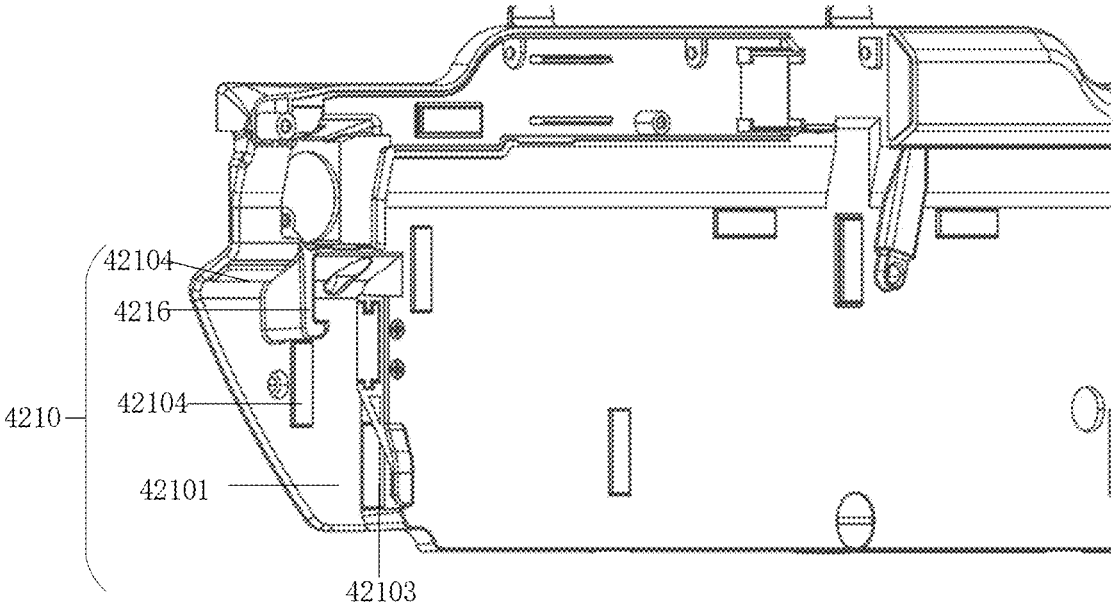
FIG. 26 is a schematic structural diagram of a clamping slot structure according to an embodiment of the present disclosure.
Figure 27:
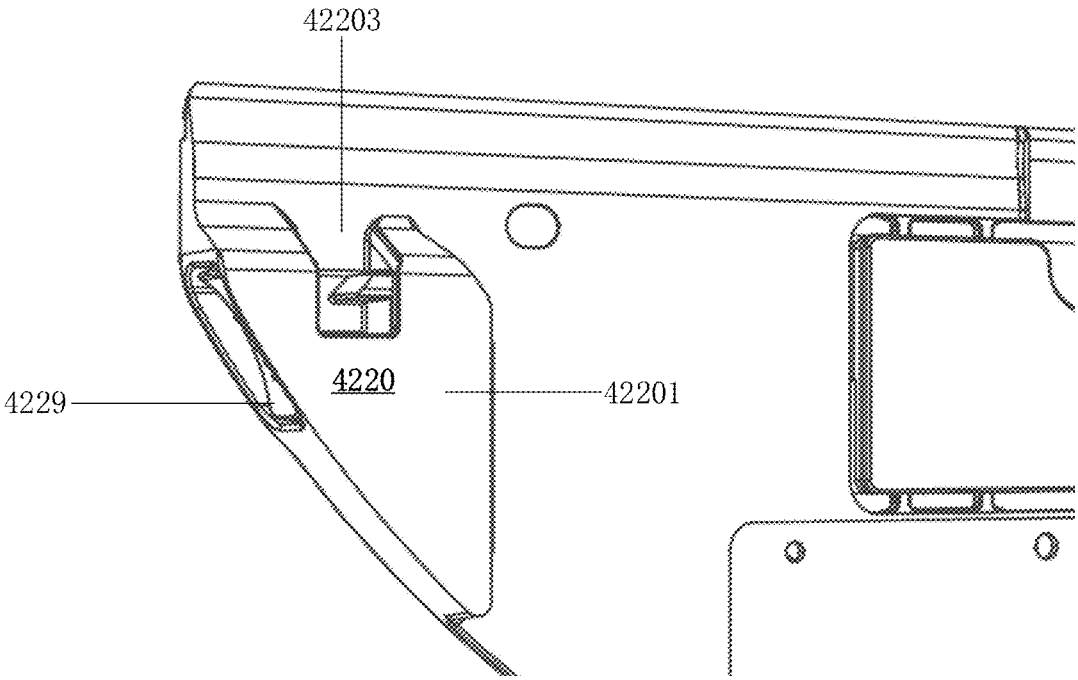
FIG. 27 is a schematic diagram of a pressing structure according to an embodiment of the present disclosure.
Figure 28:
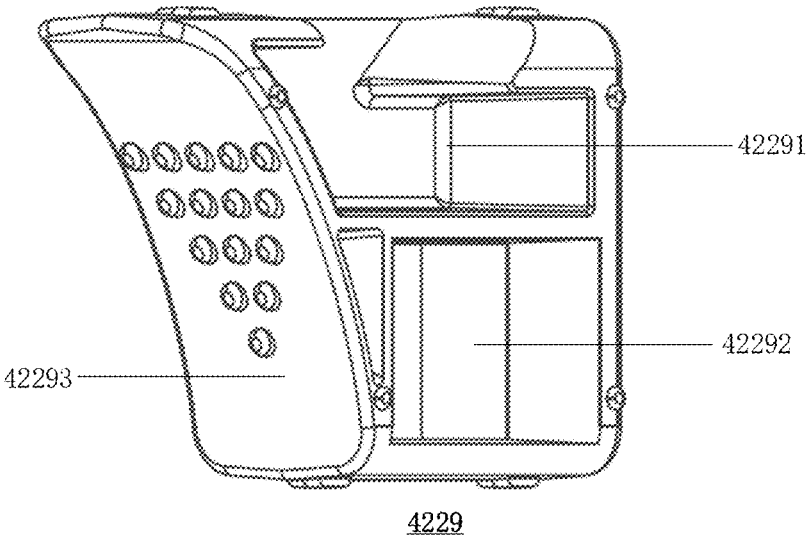
FIG. 28 is a schematic structural diagram of an elastic detaching button according to an embodiment of the present disclosure.

As an optional embodiment, as shown in FIG. 26 to FIG. 28, the driving platform 421 from FIG. 10 includes at least one clamping slot structure 4210. The supporting platform 422 from FIGS. 13 and 14 includes at least one pressing structure 4220. The pressing structure 4220 and the clamping slot structure 4210 cooperate to achieve a detachable connection between the supporting platform 422 and the driving platform 421. In some examples, the clamping structures 4210 are symmetrically arranged on two sides of the driving platform 421, and/or the pressing structures 4220 are symmetrically arranged on two sides of the supporting platform 422. The driving platform 421 is provided with the clamping slot structure, and the supporting platform is provided with the pressing structure, so that the pressing structure and the clamping slot structure cooperate to achieve the detachable connection between the supporting platform and the driving platform, thereby facilitating repair and maintenance of the cleaning device.

As an optional embodiment, the clamping slot structure 4210 includes an accommodating slot 42101 configured to accommodate the pressing structure 4220; and a pawl 4216 configured to fix the pressing structure 4220 when the pressing structure 4220 is inserted into the accommodating slot 42101. In some examples, the clamping slot structure 4210 further includes at least one buffer pad 42104 located within the accommodating slot 42101 and configured to relieve a frictional force between the pressing structure 4220 and the accommodating slot 42101. In some examples, the clamping slot structure 4210 further includes a sliding slot 42103 formed at an inlet of the clamping slot structure 4210 and configured to guide the pressing structure 4220 to be inserted into the accommodating slot 42101.

As an optional embodiment, the pressing structure 4220 includes a pressing structure body 42201 matched with the accommodating slot 42101 in shape; and a detaching button 4229 located within the pressing structure body 42201 and cooperating with the pawl 4216 to achieve locking. In some examples, the detaching button 4229 includes a locking cavity 42291 that cooperates with the pawl 4216 to achieve locking; and an elastic cavity 42292 that achieves elastic pressing of the detaching button 4229 by a built-in spring. In some examples, the detaching button 4229 further includes a pressing surface 42293 of a concave-convex structure so as to increase a frictional force during pressing. In some examples, the pressing structure body 42201 includes a concave part 42203 for accommodating the pl 4216. When locking is required, the pawl 4216 extends into the concave part 42203 to lock with the locking cavity 42291.

The present disclosure provides the automatic cleaning device, in which the driving platform is provided with the clamping slot structure and the supporting platform is provided with the pressing structure, so that the pressing structure and the clamping slot structure cooperate to achieve a detachable connection between the supporting platform and the driving platform, thereby facilitating repair and maintenance of the cleaning device.

Figure 29:
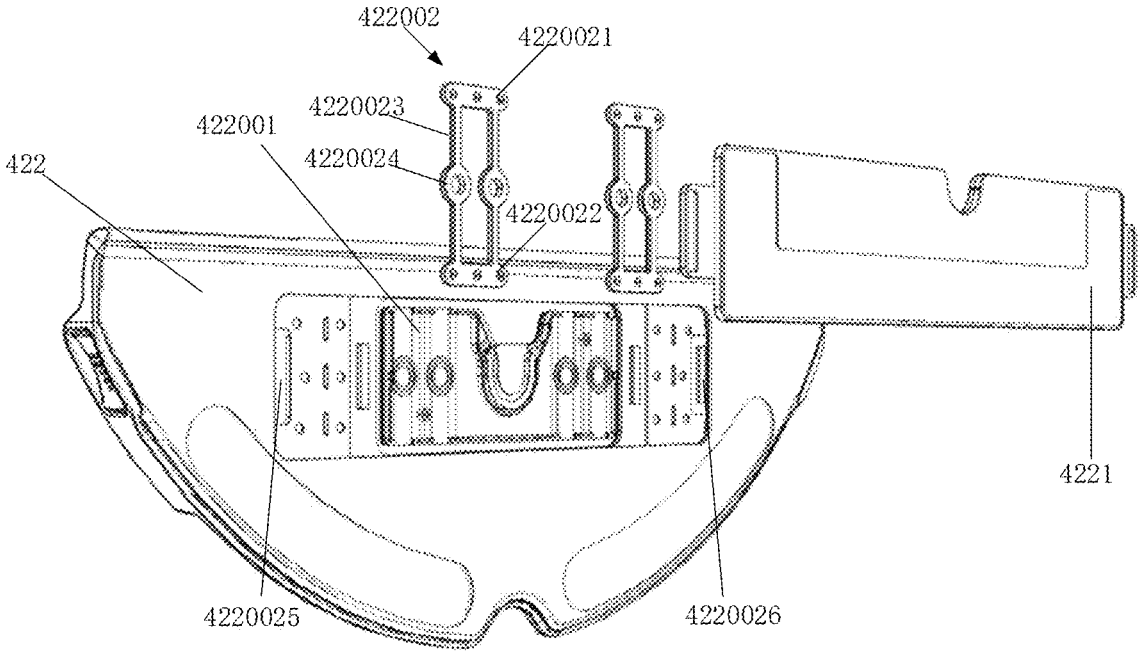
FIG. 29 is a schematic structural diagram of a clamping slot structure in a supporting platform according to an embodiment of the present disclosure.

According to a specific embodiment of the present disclosure, as shown in FIG. 9 and FIG. 29, the present disclosure provides an automatic cleaning device. The same structure in this embodiment and the foregoing embodiment achieve the same function or effect, which is not repeated herein. Specifically, the automatic cleaning device includes a mobile platform 100 configured to move automatically on an operating surface; and a cleaning module 150 arranged on the mobile platform 100. The cleaning module 150 includes a dry-cleaning module 151 configured to clean at least a part of the operating surface by means of dry cleaning, and a wet-cleaning module 400 configured to clean at least a part of the operating surface by means of wet cleaning. The wet-cleaning module 400 includes a cleaning head 410 configured to clean the operating surface; a driving unit 420 configured to drive the cleaning head 410 to reciprocate along a target surface, the target surface being a part of the operating surface; a driving platform 421 connected to the bottom surface of the mobile platform 100 and configured to provide a driving force; and a supporting platform 422 detachably connected to the driving platform 421 and configured to support the cleaning head 410. The supporting platform 422 is provided with a clamping slot 422001 in which a cleaning substrate 4221 corresponding to the clamping slot 422001 is arranged. The cleaning substrate 4221 and the clamping slot 422001 cooperate to enable the cleaning head 410 to move in a direction of the clamping slot 422001 within the supporting platform 422. Therefore, a region of movement of the cleaning head 410 and a region of mopping of the cleaning head 410 are limited, thereby avoiding reducing the cleaning effect due to an extremely large region of mopping.

As an optional embodiment, as shown in FIG. 29, an elastic bracket 422002 is arranged between the cleaning substrate 4221 and the supporting platform 422 to limit a direction of movement of the cleaning substrate 4221. In some examples, the elastic bracket 422002 includes a first end part 4220021 and a second end part 4220022, and a connecting part 4220023 for connecting the first end part to the second end part. In some examples, the connecting part 4220023 is provided with a mounting part 4220024 for securing the elastic bracket 422002 to the clamping slot 422001. In some examples, the first end part 4220021 and the second end part 4220022 of the elastic bracket 422002 are located on two sides of the cleaning substrate 4221, respectively, and are configured to limit a direction of travel of the cleaning substrate 4221. In some examples, an elastic pad is arranged between the first end part 4220021 and the cleaning substrate 4221, as well as between the second end part 4220022 and the cleaning substrate 4221, and is configured to enable the cleaning substrate to reset elastically after the cleaning substrate 4221 is in contact with the elastic pads in the process of reciprocating motion.

As an optional embodiment, a third end part 4220025 and a fourth end part 4220026 are arranged at two ends of the clamping slot 422001, and configured to limit a region of reciprocating motion of the cleaning head 410. In some examples, buffer pads are arranged on sides of the third end part 4220025 and the fourth end part 4220026 that face the cleaning substrate 4221.

As an optional embodiment, the driving platform 421 includes a motor 4211 arranged on a side of the driving platform 421 close to the mobile platform 100 and configured to output power by a motor output shaft; a driving wheel 4212 connected to the motor output shaft and being of an asymmetric structure; and a vibrating rod 4213 arranged on a side of the driving platform 421 opposite to the motor 4211, connected to the driving wheel 4212, and configured to reciprocate under asymmetrical rotation of the driving wheel 4212. The cleaning substrate 4221 includes an assembly notch formed where the cleaning substrate is in contact with the vibrating rod 4213. The vibrating rod 4213 is assembled in the assembly notch when the supporting platform 422 is connected to the driving platform 421. The cleaning head 410 reciprocates within the clamping slot under the action of the vibrating rod 4213.

The present disclosure provides the automatic cleaning device, in which the supporting platform is provided with the clamping slot, the cleaning substrate corresponding to the clamping slot is arranged in the clamping slot, and the cleaning substrate and the clamping slot cooperate to enable the cleaning head to move within the supporting platform in a direction of the clamping slot. Therefore, a region of movement of the cleaning head is limited, and a region of mopping of the cleaning head is further limited, thereby avoiding reducing the cleaning effect due to an extremely large region of mopping.

Finally, it should be noted that various embodiments in the Description are described in a progressive manner, each embodiment focuses on the differences from other embodiments, and the same or similar parts among the various embodiments may refer to one another. Since the system or device disclosed in the embodiment corresponds to the method disclosed in the embodiment, the description is relatively simple, and the relevant parts may refer to the description of the method part.

The above embodiments are only used to illustrate, instead of limit, the technical solutions of the present disclosure. Although the present disclosure is described in detail with reference to the foregoing embodiments, those of ordinary skill in the art shall be understood that they can still modify the technical solutions described in the foregoing embodiments, or make equivalent substitutions for some of the technical features; these modifications or substitutions do not deviate the nature of the corresponding technical solutions from the spirit and scope of the technical solutions of the embodiments of the present disclosure.

What is claimed is:

1. An automatic cleaning device, comprising:

a mobile platform configured to move automatically on an operating surface; and a cleaning module arranged on the mobile platform, and comprising:

a dry-cleaning module configured to clean at least a part of the operating surface by means of dry cleaning; and a wet-cleaning module configured to clean at least a part of the operating surface by means of wet cleaning, wherein the wet-cleaning module comprises:

a cleaning head configured to clean the operating surface; and a driving unit configured to drive the cleaning head to substantially reciprocate along a target surface, wherein the target surface is a part of the operating surface, and the driving unit comprises a driving platform and a supporting platform detachably connected to the driving platform;

wherein the driving platform is connected to a bottom surface of the mobile platform and configured to provide a driving force; and the supporting platform is detachably connected to the driving platform and configured to support the cleaning head; the supporting platform is provided with a clamping slot in which a cleaning substrate corresponding to the clamping slot is arranged, the cleaning substrate and the clamping slot cooperate to enable the cleaning head to move within the supporting platform in a direction of the clamping slot.

2. The automatic cleaning device according to claim 1, wherein the driving platform comprises at least one clamping slot structure; and the supporting platform comprises at least one pressing structure, wherein the pressing structure and the clamping slot structure cooperate to achieve a detachable connection between the supporting platform and the driving platform.

3. The automatic cleaning device according to claim 2, wherein the clamping slot structure comprises:

an accommodating slot configured to accommodate the pressing structure; and a pawl configured to fix the pressing structure when the pressing structure is inserted into the accommodating slot.

4. The automatic cleaning device according to claim 3, wherein the clamping slot structure further comprises at least one buffer pad located in the accommodating slot and configured to reduce a frictional force between the pressing structure and the accommodating slot.

5. The automatic cleaning device according to claim 3, wherein the clamping slot structure further comprises a sliding slot formed at an inlet of the clamping slot structure and configured to guide the pressing structure to be inserted into the accommodating slot.

6. The automatic cleaning device according to claim 3, wherein the pressing structure comprises:

a pressing structure body matched with the accommodating slot in shape; and a detaching button located within the pressing structure body and cooperating with the pawl to achieve locking.

7. The automatic cleaning device according to claim 6, wherein the detaching button comprises:

a locking cavity that cooperates with the pawl to achieve locking; and an elastic cavity that achieves elastic pressing of the detaching button by a built-in spring.

8. The automatic cleaning device according to claim 7, wherein the detaching button further comprises a pressing surface of a concave-convex structure.

9. The automatic cleaning device according to claim 8, wherein the pressing structure body comprises a concave part accommodating the pawl.

10. The automatic cleaning device according to claim 2, wherein the clamping slot structure is symmetrically arranged on two sides of the driving platform and/or the pressing structure is symmetrically arranged on two sides of the supporting platform.

11. The automatic cleaning device according to claim 1, wherein an elastic bracket is arranged between the cleaning substrate and the supporting platform and configured to limit a direction of movement of the cleaning substrate.

12. The automatic cleaning device according to claim 11, wherein the elastic bracket includes a first end part and a second end part, and a connecting part for connecting the first end part to the second end part.

13. The automatic cleaning device according to claim 12, the connecting part is provided with a mounting part for securing the elastic bracket to the clamping slot.

14. The automatic cleaning device according to claim 12, wherein the first end part and the second end part of the elastic bracket are located on two sides of the cleaning substrate, respectively, and are configured to limit a direction of travel of the cleaning substrate.

15. The automatic cleaning device according to claim 12, wherein elastic pads are arranged between the first end part and the cleaning substrate, as well as between the second end part and the cleaning substrate, and are configured to enable the cleaning substrate to reset elastically after the cleaning substrate is in contact with the elastic pads in a process of reciprocating motion.

16. The automatic cleaning device according to claim 1, wherein a third end part and a fourth end part are arranged at two ends of the clamping slot, respectively, and are configured to limit a region of reciprocating motion of the cleaning head.

17. The automatic cleaning device according to claim 16, wherein buffer pads are arranged on sides of the third end part and the fourth end part that face the cleaning substrate.

18. The automatic cleaning device according to claim 1, wherein the driving platform comprises: a motor arranged on a side of the driving platform close to the mobile platform and configured to output power by a motor output shaft; a driving wheel connected to the motor output shaft and being of an asymmetric structure; and a vibrating rod arranged on a side of the driving platform opposite to the motor, connected to the driving wheel, and configured to reciprocate under asymmetrical rotation of the driving wheel.

19. The automatic cleaning device according to claim 1, wherein the cleaning substrate includes an assembly notch formed where the cleaning substrate is in contact with the vibrating rod, the vibrating rod is assembled in the assembly notch when the supporting platform is connected to the driving platform, and the cleaning head reciprocates in the clamping slot under the action of the vibrating rod.

* * * * *